US012752966B2

(12) United States Patent
Turner et al.

(10) Patent No.: US 12,752,966 B2
(45) Date of Patent: Oct. 6, 2026

(54) COLLAPSIBLE SHIPPING CONTAINERS

(71) Applicant: REUSABLES DEVELOPMENT GROUP, LLC, Cincinnati, OH (US)

(72) Inventors: Todd T. Turner, Corydon, IN (US); Daniel Jakubiak, Waterford, MI (US); Jeffrey Mitchell, Louisville, KY (US)

(73) Assignee: REUSABLES DEVELOPMENT GROUP, LLC, Cincinnati, OH (US)

( * ) Notice: Subject to any disclaimer, the term of this patent is extended or adjusted under 35 U.S.C. 154(b) by 29 days.

(21) Appl. No.: 18/923,756

(22) Filed: Oct. 23, 2024

(65) Prior Publication Data

US 2025/0128854 A1 Apr. 24, 2025

Related U.S. Application Data

(60) Provisional application No. 63/592,592, filed on Oct. 24, 2023.

(51) Int. Cl.
*B65D 19/06* (2006.01)
*B65D 6/18* (2006.01)
(Continued)

(52) U.S. Cl.
CPC ..... *B65D 19/06* (2013.01); *B65D 11/1833* (2013.01); *B65D 19/38* (2013.01);
(Continued)

(58) Field of Classification Search
CPC ..... B65D 19/06; B65D 19/20; B65D 19/38; B65D 21/086; B65D 2519/00582;
(Continued)

(56) References Cited

U.S. PATENT DOCUMENTS 4,674,647 A * 6/1987 Gyenge ..... B65D 19/18 220/6
4,923,079 A * 5/1990 Foy ..... B65D 19/18 220/326
(Continued)

FOREIGN PATENT DOCUMENTS

CN 100572203 C 12/2009
CN 210213116 U 3/2020
(Continued)

OTHER PUBLICATIONS

United States Patent and Trademark Office; Notification of Transmittal of the International Search Report and the Written Opinion of the International Searching Authority, or the Declaration; PCT Search Report and Written Opinion for PCT/US2024/052471; Feb. 25, 2025; pp. 1-15; The United States Patent and Trademark Office; US.
(Continued)

*Primary Examiner* — Nathan J Jenness
*Assistant Examiner* — Jennifer Castriotta
(74) *Attorney, Agent, or Firm* — Bricker Graydon Wyatt LLP; Max E. Bridges; Matthew A. Williams

(57) ABSTRACT

Collapsible bulk shipping containers comprising sidewalls which interlock with another in a unique stair step arrangement, a series of curved protrusions (or arches) which extend along the entire length and/or the entire height of the sidewalls, collapsible sidewalls which permit the shipping containers to fold flat in a much smaller fraction than conventional bins, and a base having one or more support grids with a series of curved ribs. In some embodiments, the shipping containers are not collapsible and comprise the series of curved protrusions (or arches) which extend along a length and/or a height of one or more of the sidewalls.

20 Claims, 43 Drawing Sheets

(51) Int. Cl.
*B65D 19/38* (2006.01)
*B65D 21/08* (2006.01)

(52) U.S. Cl.
CPC ..... *B65D 21/086* (2013.01); *B65D 2519/00582* (2013.01); *B65D 2519/00611* (2013.01); *B65D 2519/009* (2013.01)

(58) Field of Classification Search
CPC ..... B65D 2519/00587; B65D 2519/00611; B65D 2519/009; B65D 11/1833
USPC ..... 220/6
See application file for complete search history.

(56) References Cited

U.S. PATENT DOCUMENTS

| | | | | |
|---|---|---|---|---|
| 6,409,041 | B1 | 6/2002 | Overholt et al. | |
| 6,631,822 | B1 * | 10/2003 | Overholt | B65D 11/1833 220/7 |
| 6,863,180 | B2 | 3/2005 | Apps et al. | |
| 7,669,713 | B2 | 3/2010 | Stahl | |
| 8,052,000 | B2 | 11/2011 | Apps | |
| 8,256,640 | B2 | 9/2012 | Luburic et al. | |
| 8,875,924 | B2 | 11/2014 | Ordeldinger | |
| 9,296,514 | B2 | 3/2016 | Ficker | |
| 11,066,233 | B2 | 7/2021 | Jian | |
| D1,028,521 | S | 5/2024 | Turner | |
| 2002/0130132 | A1 * | 9/2002 | Overholt | B65D 11/1833 220/623 |
| 2007/0017916 | A1 * | 1/2007 | Sabanci | B65D 11/1833 220/7 |
| 2017/0137175 | A1 | 5/2017 | Park | |
| 2017/0313498 | A1 | 11/2017 | Mallan | |
| 2022/0041328 | A1 | 2/2022 | Jian et al. | |
| 2023/0028969 | A1 | 1/2023 | Turner | |

FOREIGN PATENT DOCUMENTS

| | | | |
|---|---|---|---|
| GB | 817690 | A | 8/1959 |
| JP | 4328038 | B | 9/2009 |
| JP | 6791572 | B | 11/2020 |
| JP | 6800516 | B2 | 12/2020 |
| JP | 2022093029 | A | 6/2022 |
| JP | 7106116 | B | 7/2022 |

OTHER PUBLICATIONS

Collapsible Bulk Container, Uline Shipping Supplies, Retrieved Aug. 14, 2024, https://www.uline.com/Product/Detail/H-7831G/Bulk-Containers/Collapsible-Bulk-Container-48-x-45-x-34-1500-lb-Capacity-Green.

Sleeve Packs, Orbis Corporation, Retrieved Oct. 24, 2024, https://www.orbiscorporation.com/en-us/products/bulk-containers/sleeve-packs/.

* cited by examiner

COLLAPSIBLE SHIPPING CONTAINERS

CROSS-REFERENCE TO RELATED APPLICATIONS

This patent application claims the benefit of and priority to U.S. Provisional Patent Application Ser. No. 63/592,592, with a filing date of Oct. 24, 2023, the contents of which are fully incorporated herein by reference.

FIELD OF INVENTION

The embodiments described herein relate to collapsible bulk shipping containers or bins having improved sidewalls, corner interlock connections, and other novel features that permit the bins to fold flat in a smaller fraction of container height than conventional bins, while maintaining a robust weight capacity, stackability, and other advantages.

BACKGROUND

Shipping containers are often used to transport bulk goods in the transportation, shipping, and agricultural industry. Collapsible shipping containers having a base and foldable side walls (i.e. movable from an upright position to a collapsed position, and vice versa), are well known. For example, sleeve packs are lightweight and collapsible shipping containers typically comprising a pallet base, a foldable sleeve, and a lid. While sleeve packs are lightweight and provide an excellent stacking ratio which reduces the return freight costs, conventional sleeve packs have a number of disadvantages including, but not limited to, a low weight capacity, sidewalls which often fall out when excess weight is added, and the separation of the sleeve from the pallet base in return shipping since the sleeve is not attached to the pallet base when the container is collapsed. The stacking ratio, also known as the return ratio, refers to the height of the bin when it is erected relative to the bin's height when fully collapsed.

Other conventional collapsible bin are capable of a much higher weight capacity; however, these traditional bins have a number of disadvantages such as being very heavy, inefficient, having thick sidewalls which decrease the volume of the bin, and a low return ratio that is often no more than 3:1, which increases the return shipping costs. In addition, conventional collapsible bins typically comprise flat walls and other flat surfaces, which are a major disadvantage because the buckling moment is uncontrolled. Buckling refers to the sudden change in shape or deformation of a structural component under load, such as the bowing of a sidewall under compression. In conventional collapsible bins with flat sidewalls (and other flat surfaces), the walls can buckle in multiple, uncontrolled directions when under a load, which greatly decreases the carrying capacity.

Accordingly, there is a significant and long-felt need for a collapsible shipping container that is lightweight and efficient, especially in return shipping, with a controlled buckling moment that provides an improved weight capacity for an equivalent bin volume while also being stackable. In addition, there has been a long-felt need to improve the return ratio in traditional collapsible bins. Along with other features and advantages outlined herein, the collapsible shipping containers within the scope of present embodiments meet these and other needs.

SUMMARY OF EMBODIMENTS

According to multiple embodiments and alternatives, the collapsible shipping containers (referred to herein as "shipping container(s)" or "bin(s)" for brevity) comprise a base having a base rim that extends vertically along the outer edge of said base, a first pair of opposing sidewalls, and a second pair of opposing sidewalls. The sidewalls are pivotably connected to the base rim and capable of moving from an upright position to a collapsed position, and from the collapsed position to the upright position.

In some embodiments, the first pair of sidewalls are pivotably connected to the top of the base rim by one or more hinge members. Each of the hinge members comprise a top hinge and a bottom hinge. The bottom of each of the first pair of sidewalls are rotatably connected to the top hinge of the hinge member. In turn, the bottom hinge is rotatably and removably connected to a corresponding hinge member slot defined by the base rim. As the first pair of sidewalls tip inward towards the collapsed position, the top hinge moves downwards towards the bottom, interior surface of the bin. Likewise, as the first pair of opposing sidewalls are pulled upward towards the upright position, the top hinge rotates upward. In some embodiments, the bottom hinge of the hinge member is adapted to move vertically, up or down, within the hinge slot as the first pair of sidewalls move inward or outward (and the top hinge rotates in a corresponding fashion). When the first pair of sidewalls are fully collapsed in and resting on the interior surface of the base, the outer surface of the collapsed first pair of sidewalls are positioned at the same height as (i.e. flush with) the top edge of the base rim portions they are pivotably connected to. In further embodiments, the outer surface of the uppermost portion of the collapsed first pair of sidewalls are positioned below the top edge of the base rim they are connected to. The base of the bin further defines a series of recesses that are adapted to receive a vertical column and the wrap-around extensions (discussed in further detail below) positioned on the inner surface of the first pair of sidewalls. The recesses permit the inner surface of the first pair of sidewalls to mate with the base of the bin and lay flat when in the fully collapsed position. In further embodiments, the outer surface of each of the first pair of sidewalls defines a recess being adapted to receive the vertical column positioned on the inner surface of the other first sidewall.

According to multiple embodiments and alternatives, the second pair of opposing sidewalls are pivotably connected to the top of the base rim by one or more hinge units which are integrally connected to, and extend downward from, the bottom edge of each of the second pair of sidewalls. Each of the hinge units define a hinge which extends outward and horizontally, and is received within a corresponding hinge unit slot defined by the base rim. The hinge units are adapted to move vertically within the hinge unit slots as the second pair of opposing sidewalls move to and from the upright and collapsed positions. Accordingly, when the bin is fully collapsed, the second pair of opposing sidewalls lay flat directly on top of the first pair of opposing sidewalls. Unlike the first pair of opposing sidewalls, the outer surface of the uppermost of the collapsed second pair of sidewalls is positioned below the top edge of the base rim portions they are pivotably connected to when fully collapsed, in some embodiments. This portion of the base rim which extends vertically above the outer surface of the second pair of opposing sidewalls (when in the collapsed position) is adapted to be received in the bottom surface of another bin thereby permitting the bins to stack on top of one another.

According to multiple embodiments and alternatives, the sides of the sidewalls interlock with another in a unique arrangement that resembles stair steps. In particular, the sides of the first pair of sidewalls each comprise a wrap-around extension that extends from the intersection of the inner surface and side edge of the first pair of sidewalls. When looking down at the bin from a plan view, the wrap-around extension generally comprises an "L-shape" having a first component integrally connected to a second component at about a ninety-degree angle, wherein the first component extends towards the interior of the bin and the second component extends outwardly. The first and second components of the wrap-around extension generally define a ninety-degree angle that extends along the entire length of the interior sides of the first pair of sidewalls. When the first pair of sidewalls mate with the second pair of sidewalls, the wrap-around extension is received by and mates with a corresponding receiving extension that is adapted to receive the wrap-around extension and the side edge of the first pair of sidewalls. The receiving extension extends from the intersection of the inner surface and side edge of each of the second pair of sidewalls. When looking down at the bin, the opposing edges of the receiving extensions resemble a series of stair steps that are adapted to receive the wrap-around extension of the first pair sidewalls.

According to multiple embodiments and alternatives, the shipping container (that may or may not be collapsible depending on the user's preference) comprises a series of curved protrusions (or arches) positioned along the entire length of one or more the sidewalls—horizontally, vertically, or in both directions—to provide strength for the container and control the buckling moment when under load. In some embodiments, the curved protrusions all curve in the same direction, are parallel to one another, and spaced apart. In further embodiments, the curved protrusions (or arches) are positioned within, and integrally connected to, one or more of the sidewalls and form a convex geometry that extends outward from the outer surface of the sidewalls and a corresponding concave geometry on the inner surface of the sidewalls, as non-limiting examples. According to multiple embodiments and alternatives, the sidewalls of the shipping container lack flat surfaces and all open areas of the sidewalls comprise a series of curved protrusions or arches. Accordingly, in some embodiments a series of curved and parallel protrusions (also referred to as columns) are positioned within one or more of the sidewalls and the curved columns (or arches) span from the bottom edge to the top edge of the sidewall(s) in a spaced apart arrangement. In further embodiments, a series of curved and parallel protrusions (or arches) are positioned in horizontal and spaced rows spanning from one side edge to the opposing side edge of one or more of the sidewalls. It will be appreciated by one of ordinary skill in the art that the series of curved protrusions ensure that the sidewalls buckle in the same direction, providing additional support for the bins and increasing the weight capacity. In some embodiments, a top portion of one or more of the sidewalls comprises an optional a drop-down side door that rotates outwardly from the bin and is adapted to latch with a main member of one or more of the sidewalls.

According to multiple embodiments and alternatives, the base of the shipping container comprises a bottom member having a support structure and a top member, wherein the top and bottom members are welded together. It will be appreciated that the top and bottom members of the base may be connected in a number of other ways including snap connections, being glued together, and others. In some embodiments, the top surface of the bottom member and the bottom surface of the top member each comprise a support grid having a series of curved ribs. Compared to conventional bins that typically comprise support grids having sharp, ninety-degree edges, the curved (or arched) support grid(s) of the shipping containers in present embodiments allow for the use of thinner, lighter materials and provide stronger support for the bin.

Compared to conventional collapsible bins, the collapsible shipping containers according to multiple embodiments and alternatives comprise improved sidewall connections (or interlocks) having a "stair step" configuration with receiving extensions adapted to receive wrap-around extensions, a series of curved, spaced apart protrusions (or arches) in the sidewalls (spanning horizontally, vertically, or in both directions and being curved in the same direction) that maintain the buckling moment in one direction and increase the strength of the bins, curved support grid(s) in the base, and improved hinges that allow the bin to fold flat in a smaller fraction of container height than conventional bins. Accordingly, the collapsible shipping containers provide a robust weight capacity while using lighter and more efficient materials, and provide an improved stacking ratio. The collapsible shipping containers provide a number of advantages over conventional collapsible bins and address a number of long-felt needs such as poor stacking ratios, low weight capacities, and uncontrolled buckling moments, along with other features and advantages disclosed herein.

BRIEF DESCRIPTION OF THE FIGURES

The drawings and embodiments described herein are illustrative of multiple alternative structures, aspects, and features of the present embodiments, and they are not to be understood as limiting the scope of present embodiments. It will be further understood that the drawing Figures described and provided herein are not to scale, and that the embodiments are not limited to the precise arrangements and instrumentalities shown.

FIGS. 1A-1I are perspective views of a collapsible shipping container moving from an upright position (as shown in FIG. 1A) to a collapsed position (as shown in FIG. 1I), according to multiple embodiments and alternatives.

MULTIPLE EMBODIMENTS AND ALTERNATIVES

Figure 1A:
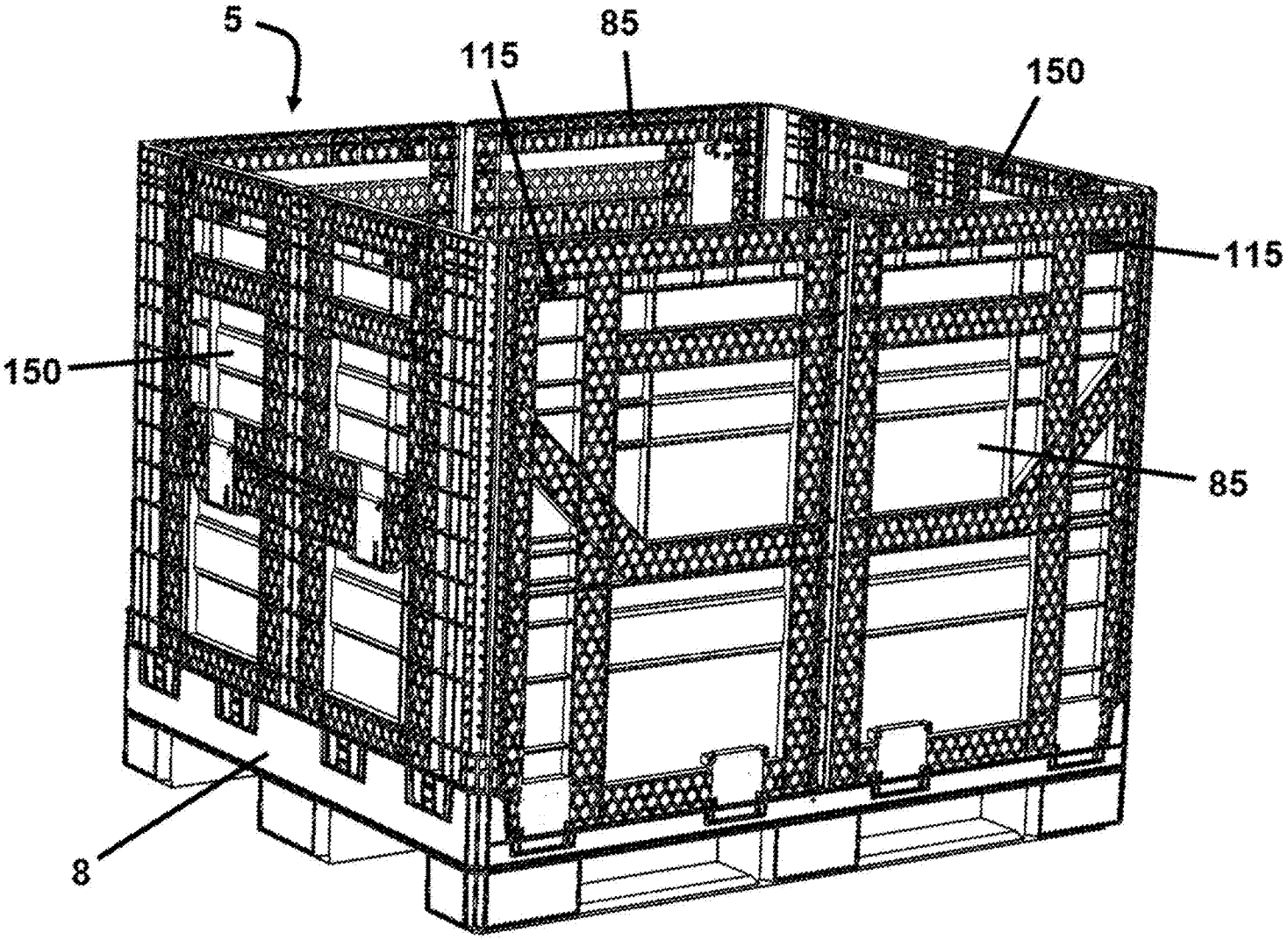
Figure 1B:
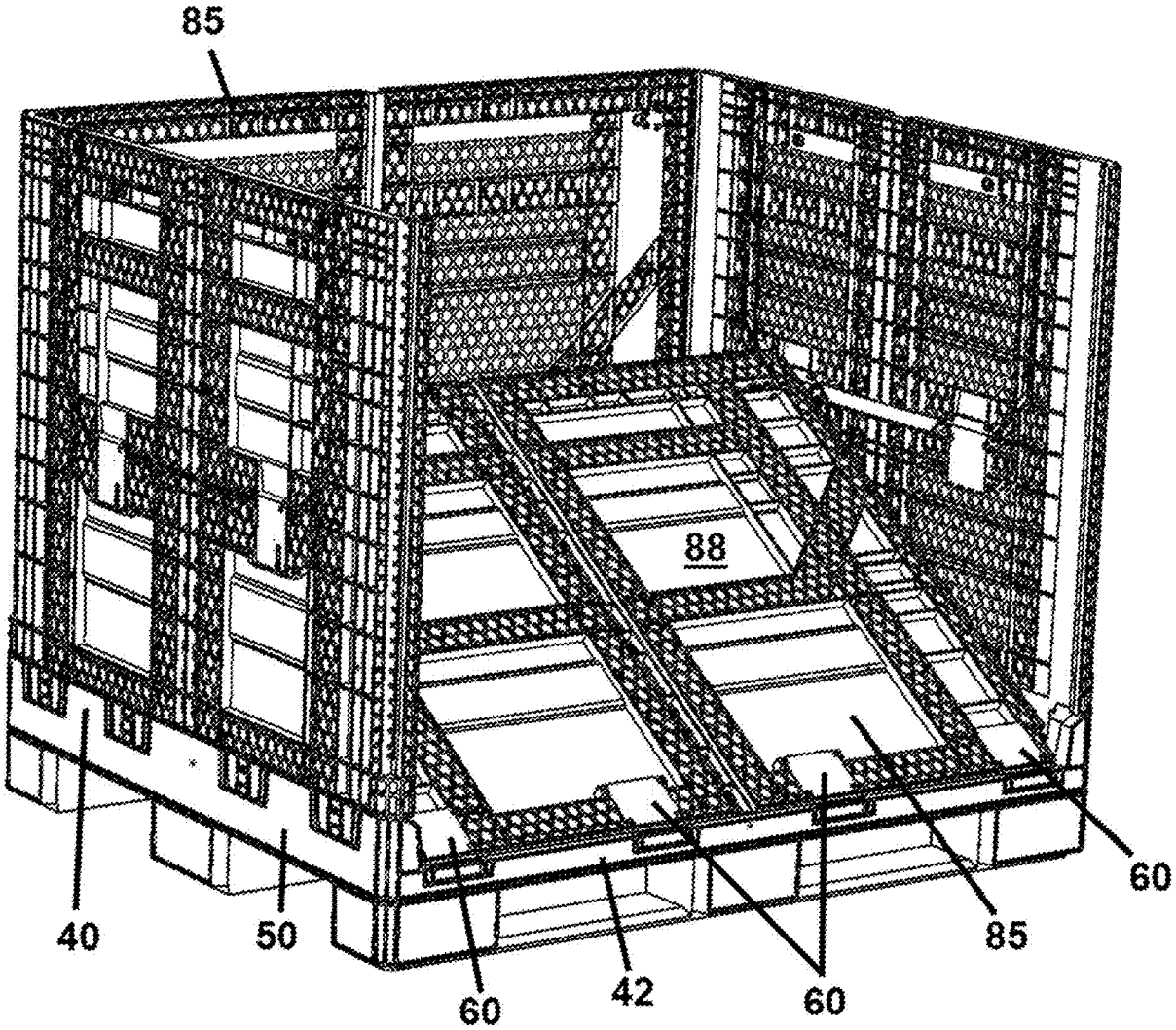
Figure 1C:
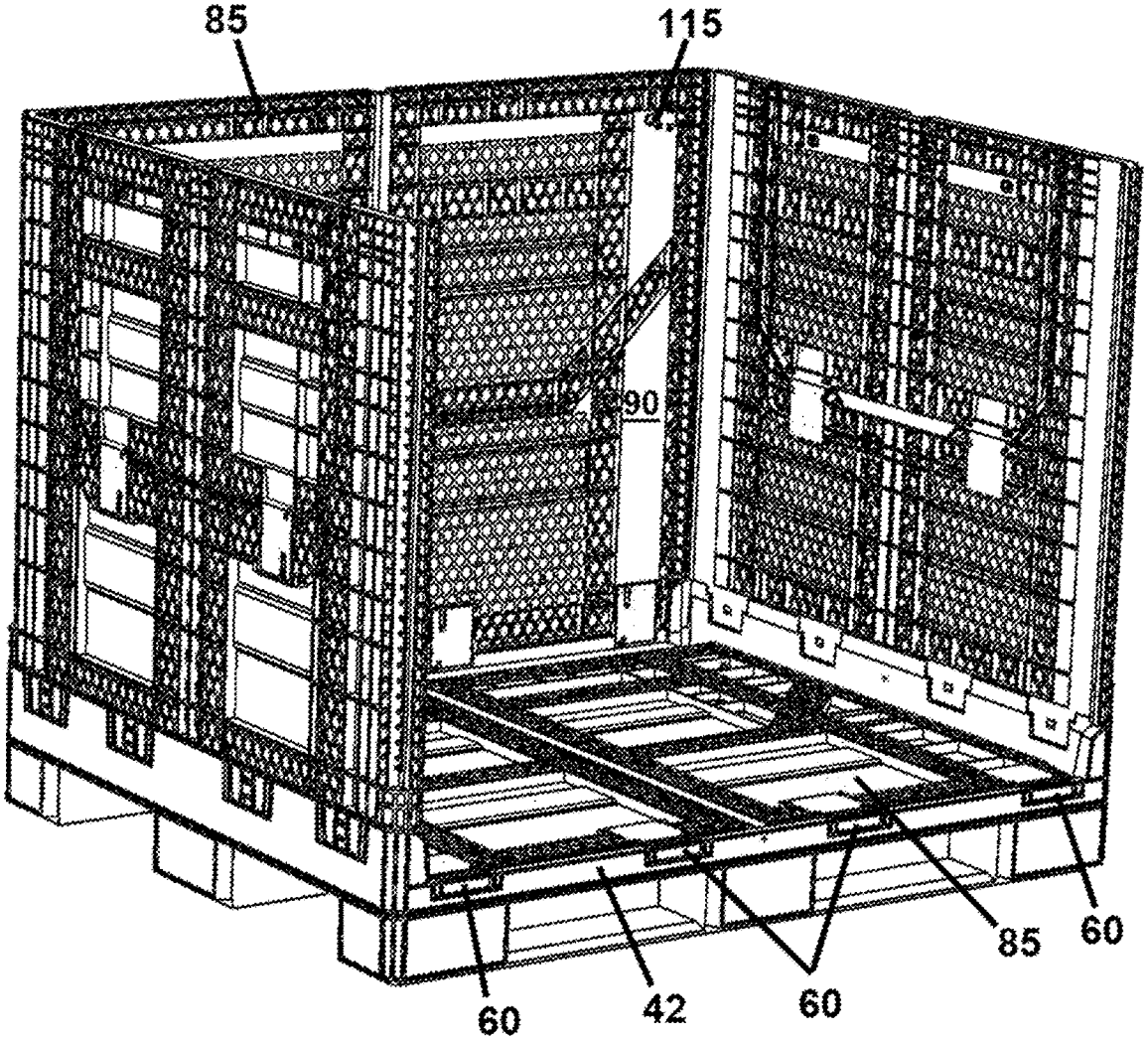
Figure 1D:
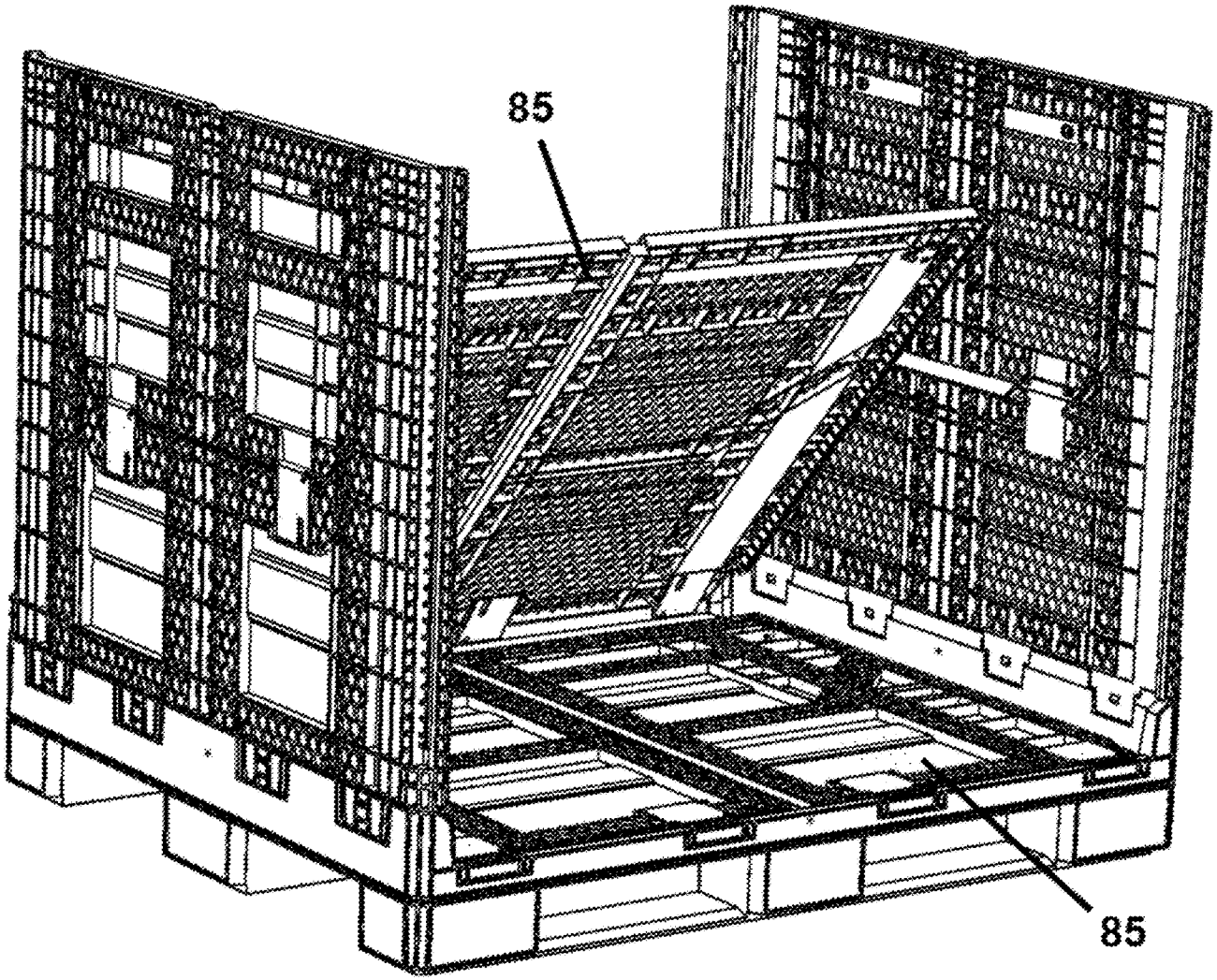
Figure 1E:
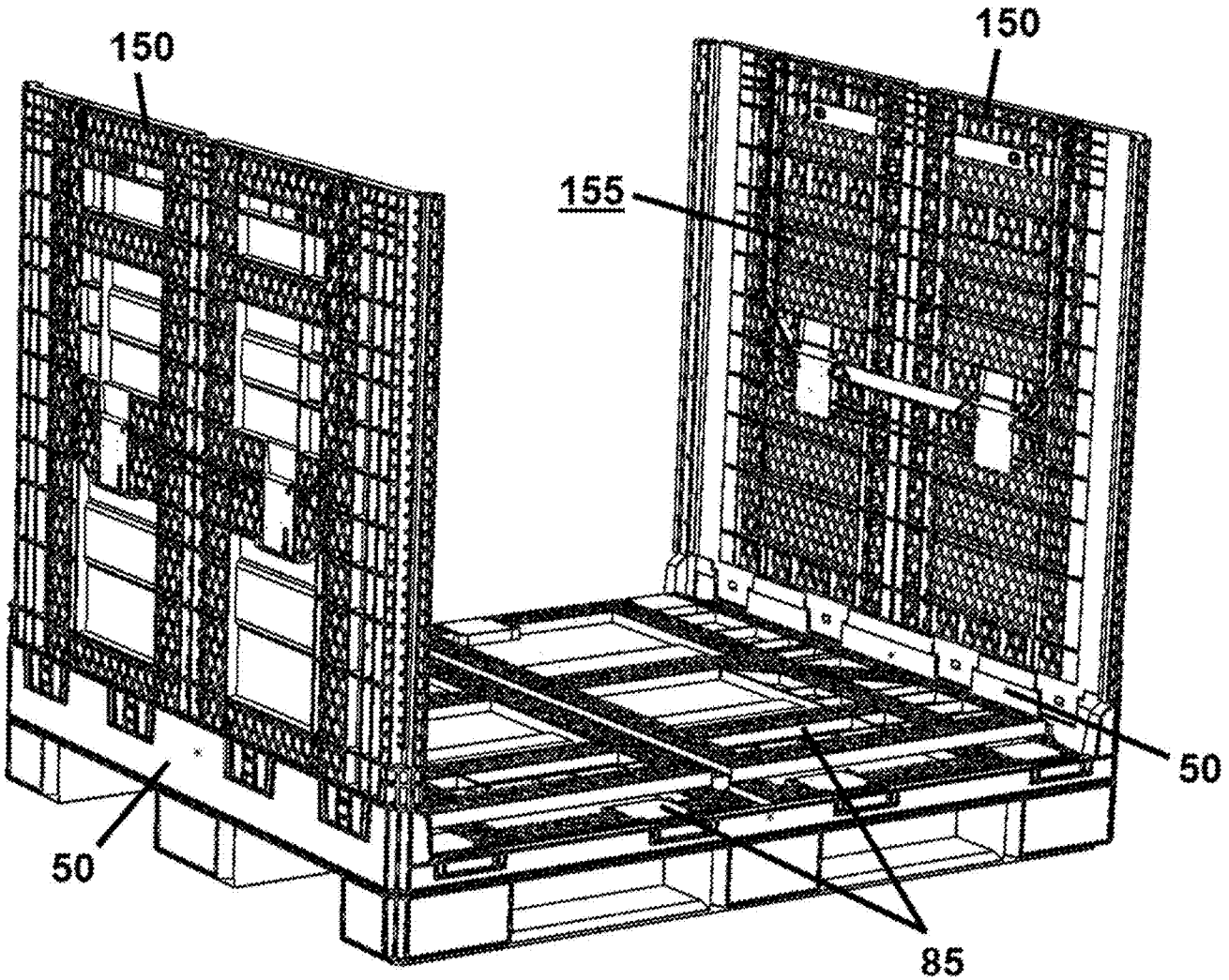

According to multiple embodiments and alternatives, FIGS. 1A-1I illustrate a collapsible shipping container 5 comprising a base 8 having a base rim 40, a first pair of opposing sidewalls 85 and a second pair of opposing sidewalls 150 being pivotably connected to the base rim 40. The base rim 40 extends vertically along the outer edge of the base 8 and comprises a first set of opposing side rims 42 and a second set of opposing side rims 50 positioned above the first side rims 42 (as best shown in FIG. 1E). The first pair of opposing sidewalls 85 are pivotably connected to the first set of side rims 42 of the base rim 40 by one or more hinge members 60. In further embodiments, the second pair of opposing sidewalls 150 are directly and pivotably connected to the second set of side rims 50 of the base rim 40 by one or more hinge units 162 (which are discussed in more detail below).

FIG. 1A illustrates the container 5 in an upright position in which the sidewalls 85, 150 extend vertically, FIGS. 1B-1H illustrate the container 5 moving from the upright to the collapsed position, and FIG. 1I illustrates the container 5 in a collapsed positioned in which the sidewalls 85, 150 lay flat upon one another and are received within the top surface 30 (i.e. the bottom) of the container 5. It will be appreciated that container 5 is adapted to move from the upright position to the collapsed position, and vice versa.

Figure 1F:
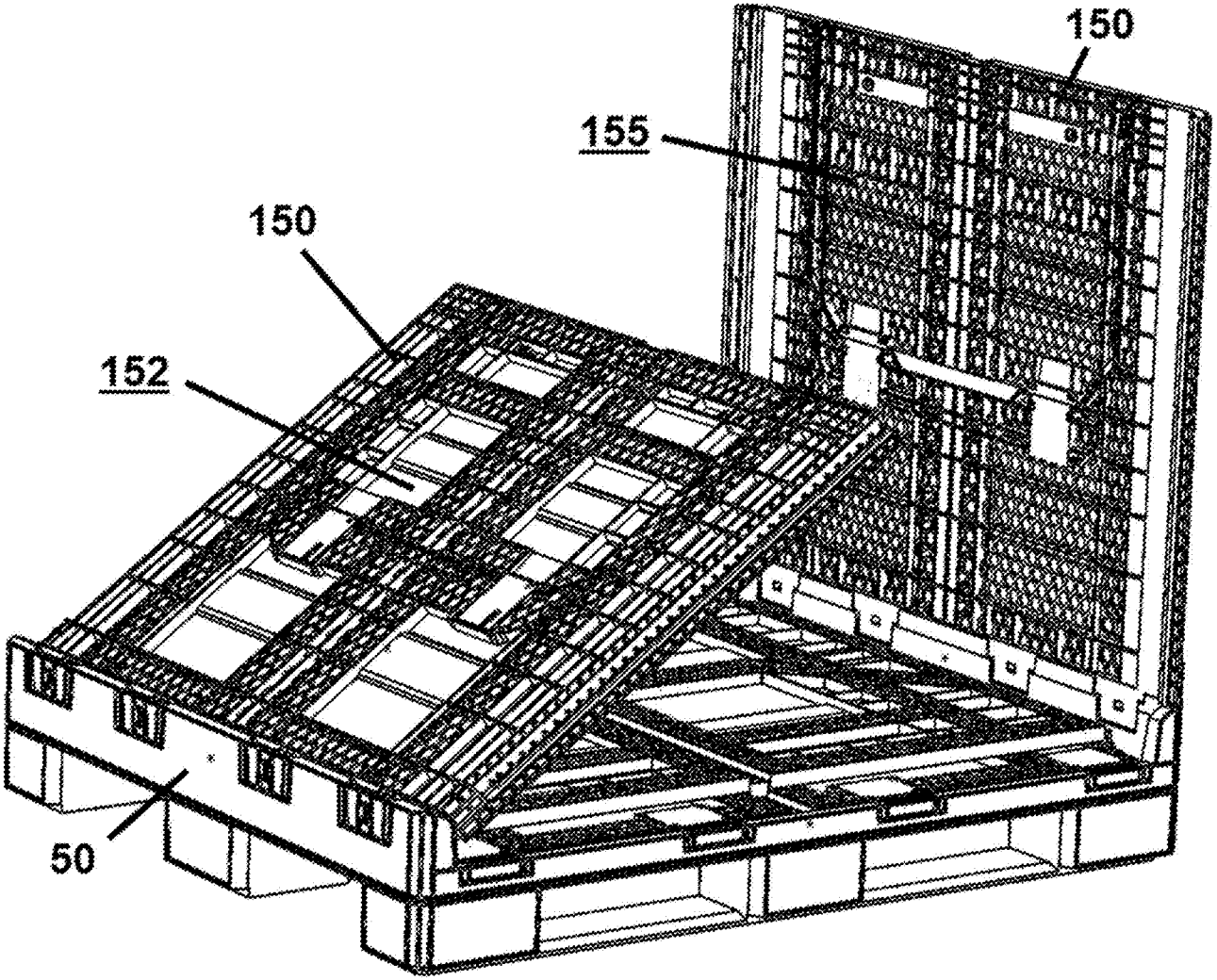
Figure 1G:
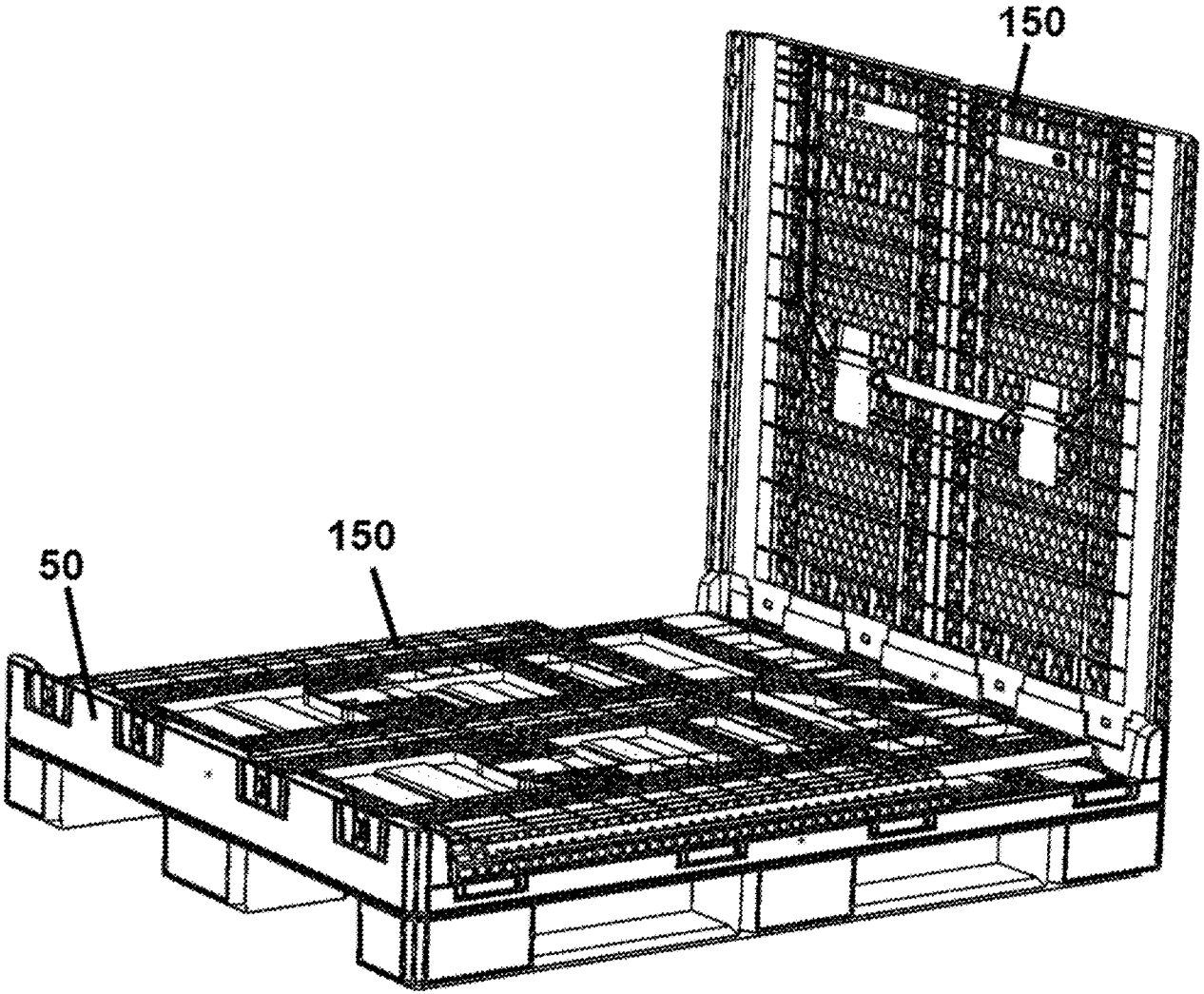
Figure 1H:
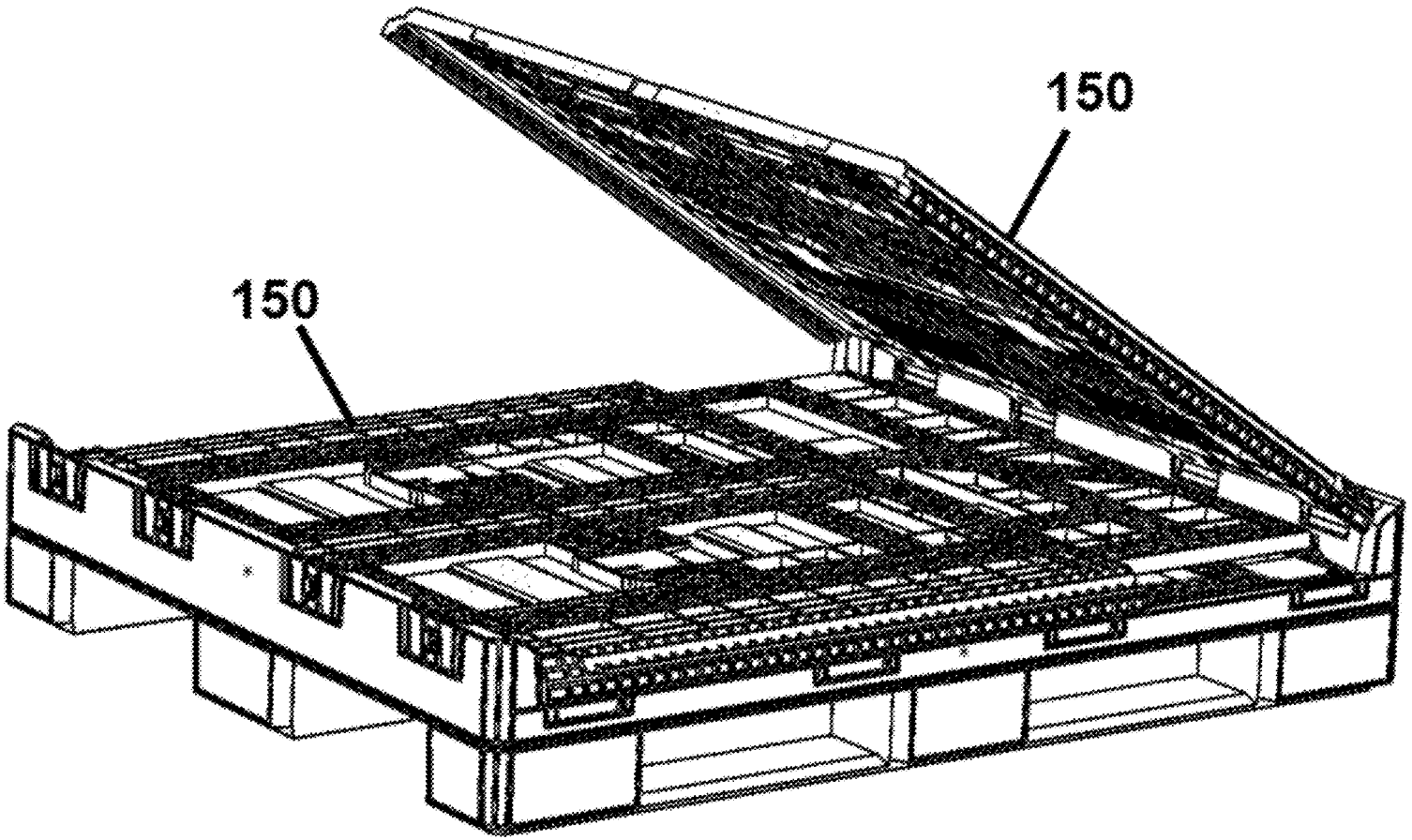
Figure 11:
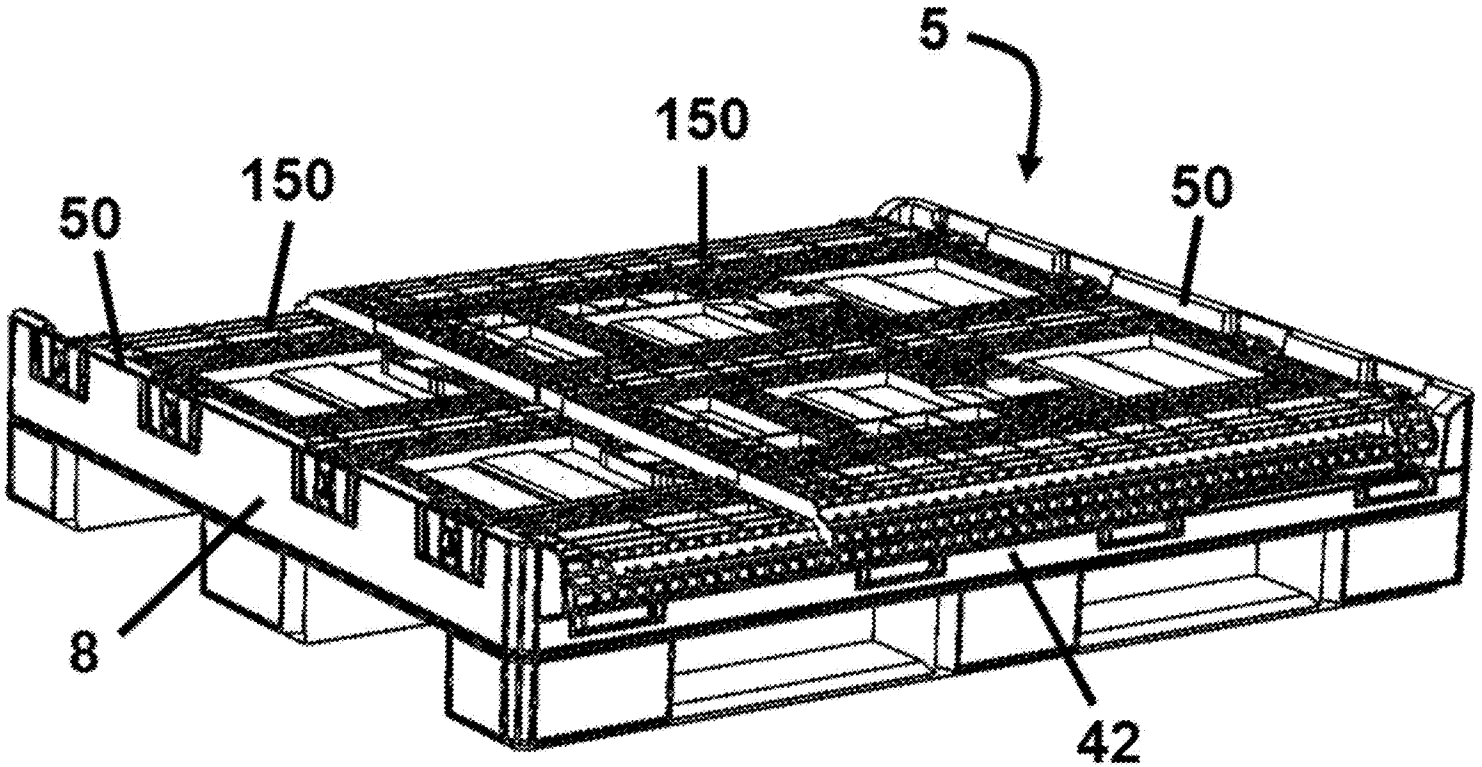
FIG. 11A is a perspective view of a portion of a first pair of sidewalls, according to multiple embodiments and alternatives.
FIG. 11B is a close-up view of a hinge member recess of a first pair of sidewalls, according to multiple embodiments and alternatives.

As shown in FIGS. 1B-1D, the first pair of sidewalls 85 have an outer surface 88 and an inner surface 90. In some embodiments, either of the first sidewalls 85 are adapted to fold down first (i.e. there is no required order between the sidewalls 85) until the inner surface 90 mates with the top surface 30 of the bin. As shown in FIG. 1C, once a first sidewall 85 lays flat upon the top surface 30, the outer surface 88 of the first sidewall 85 is positioned at the same height and is flush with the top edge 48 of the base rim 40. In further embodiments, the outer surface 88 is positioned below the top edge 48 of the base rim 40. As shown in FIGS. 1D-1E, the other first sidewall 85 (in the upright position) then lays flat until its inner surface 90 mates with the outer surface 88 of the first sidewall 85 which is already lying flat. Next, either of the second pair of sidewalls 150 are adapted to fold down and there is no required order between these sidewalls. As shown in FIGS. 1F to 1G, a second sidewall 150 is adapted to lay flat until its inner surface 155 mates with the outer surface 88 of the uppermost, first sidewall 85. As illustrated in FIGS. 1H to 1I, once one of the second sidewalls 150 lays flat, the remaining second sidewall 150 (in the upright position) rotates downward until its inner surface 155 mates with the outer surface 152 of the second sidewall 150 which is already lying flat in the container 5.

When the container 5 is in the fully collapsed position (as illustrated in FIG. 1I), the second pair of opposing sidewalls 150 lay flat directly on top of the first pair of opposing side rims 50 which, in turn, lay on top of the top surface 30 of the bin. As shown in FIG. 1I, when in the collapsed position, the outer surface 152 of the second pair of opposing sidewalls 150 are positioned below the top edge 55 of the base rim 40 and are not flush (unlike the first pair of sidewalls 85), according to multiple embodiments and alternatives. The portions of the second set of side rims 50 of the base rim 40 that extend vertically above the second pair of sidewalls 150 are adapted to be received in the receiving grooves 26 (best illustrated in FIG. 2B) positioned on the bottom of the bin to permit the bins 5 to stack on top of one another.

Figure 2A:
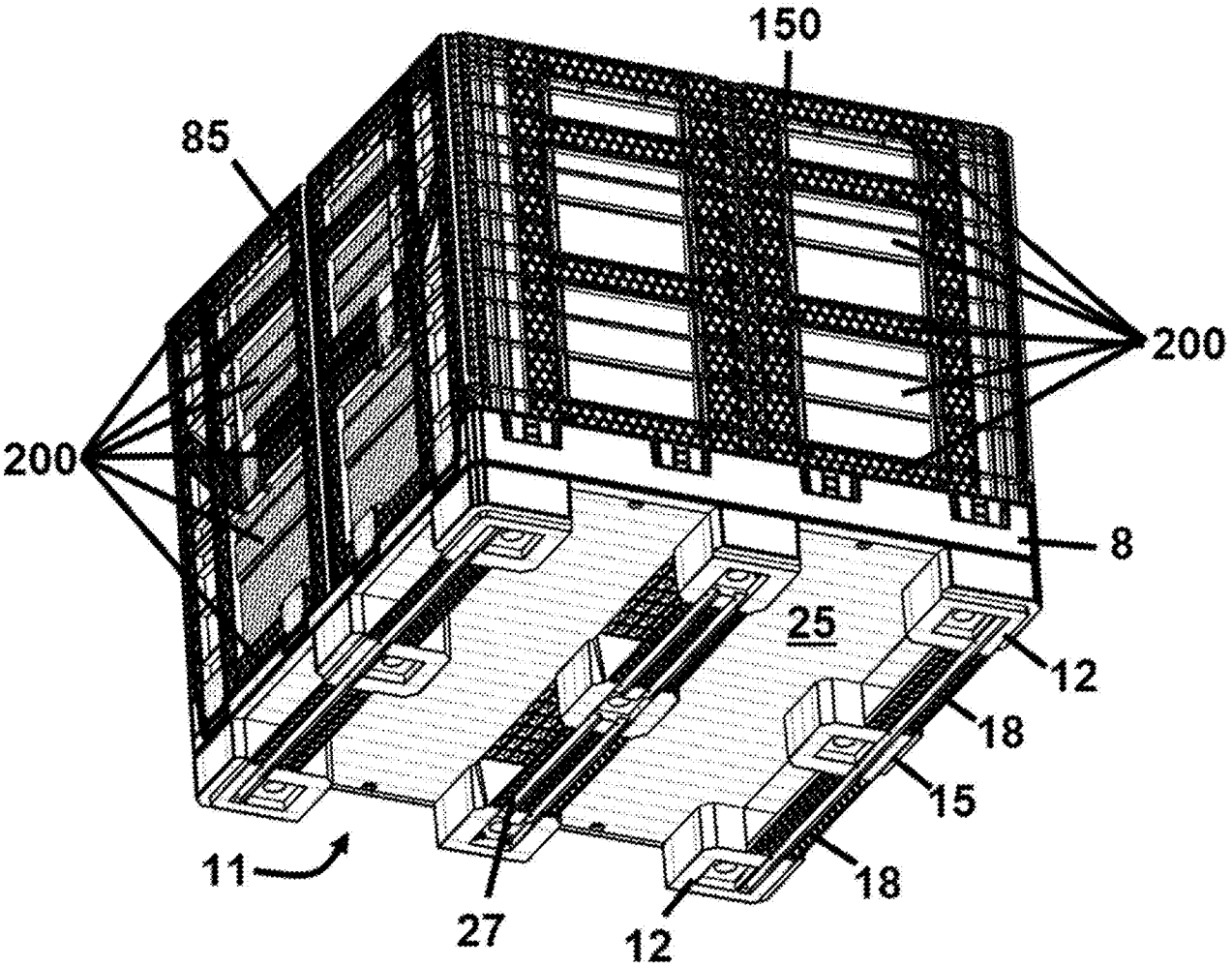
FIGS. 2A-2B are bottom, perspective views of a collapsible shipping container, according to multiple embodiments and alternatives.
Figure 2B:
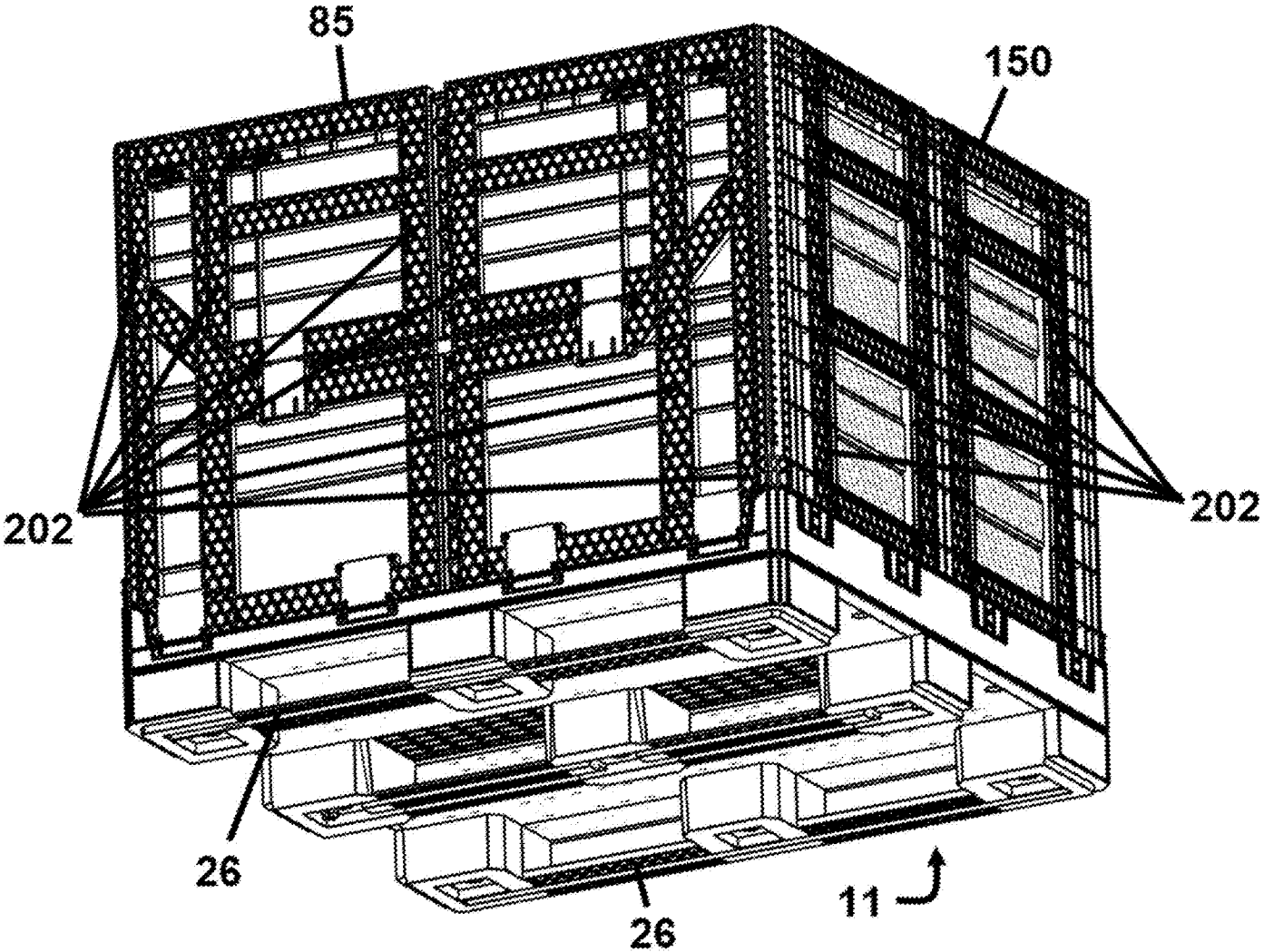

As shown in FIGS. 2A to 2B, the base 8 comprises a support structure 1I which extends downward from the bottom surface 25 of the container 5. In some embodiments, the support structure 1I comprises a series of end components 12 which are positioned at the corners of the bottom of the container 5, middle components 15 positioned between said end components 12, and connections 18 which span horizontally between the end components 12 and the middle components 15. The connections 18 define grooves 26 which extend along the length of the support structure 1I and are adapted to receive a portion of the base rim 40 to permit stacking of the bins 5. As illustrated in FIG. 2A, the support structure 1I further comprises a middle unit 27 having a pair of opposing end components 12, a middle component, and a connection, wherein the middle unit 27 extends from the middle of the bottom surface 25. In some embodiments, the middle unit 27 has a narrower width which allows a stand-up forklift to pick-up the support structure 1I of the bin. It will be appreciated by one of ordinary skill in the art that a stand-up forklift is generally shorter and more compact than a sit-down forklift.

Figure 15B:
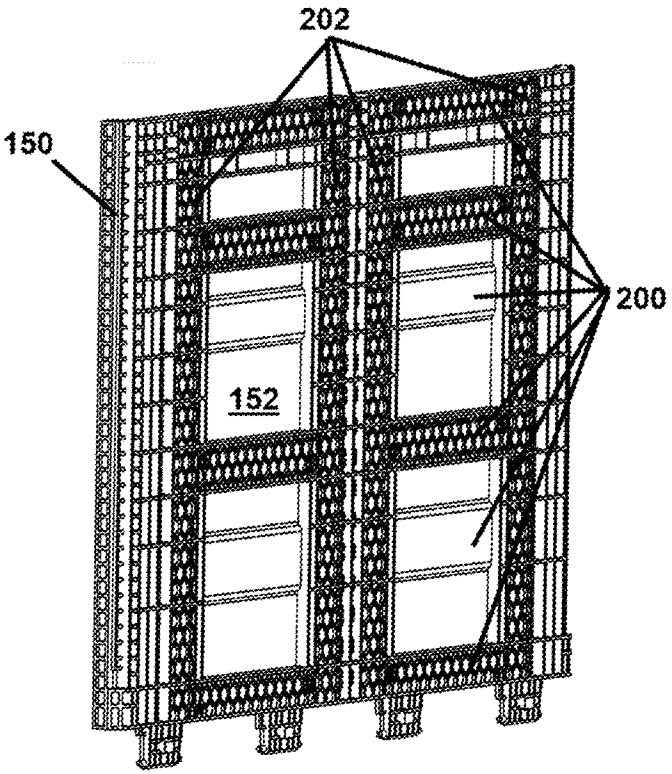
FIG. 15B is a perspective view of the external side of a second sidewall, according to multiple embodiments and alternatives.
Figure 15A:
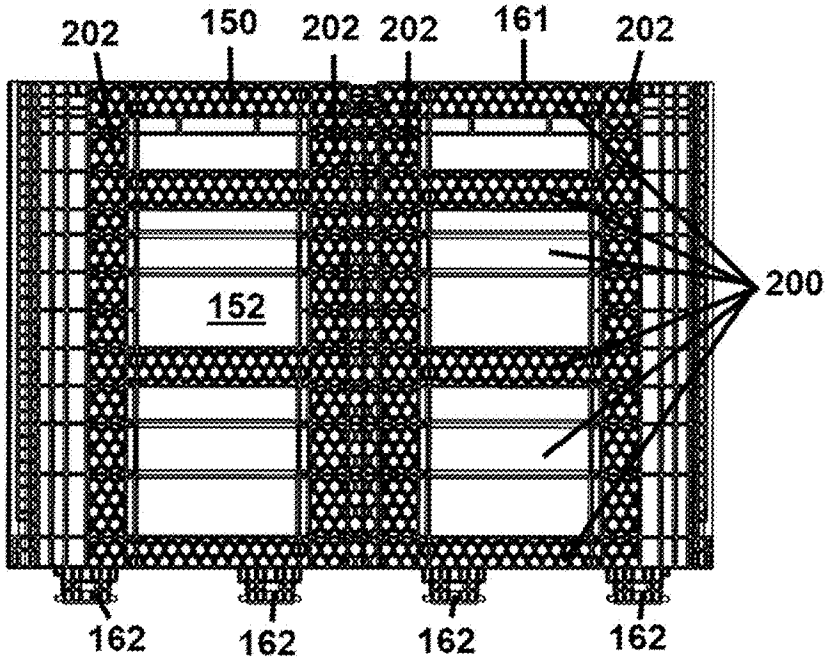
FIG. 15A is a front view of the external side of a second sidewall, according to multiple embodiments and alternatives.
Figure 15C:
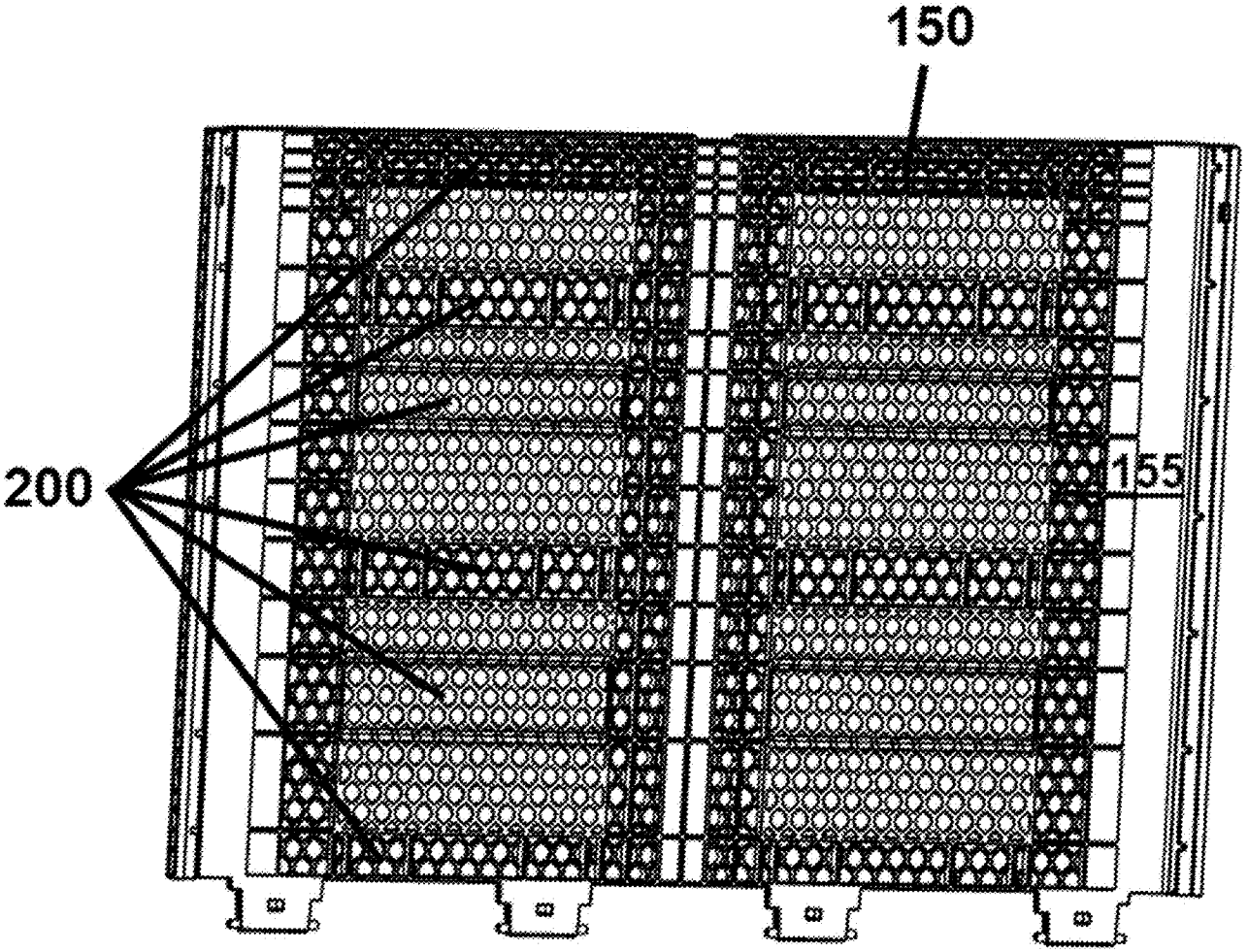
FIG. 15C is a perspective view of the internal side of a second sidewall, according to multiple embodiments and alternatives.
Figure 15D:
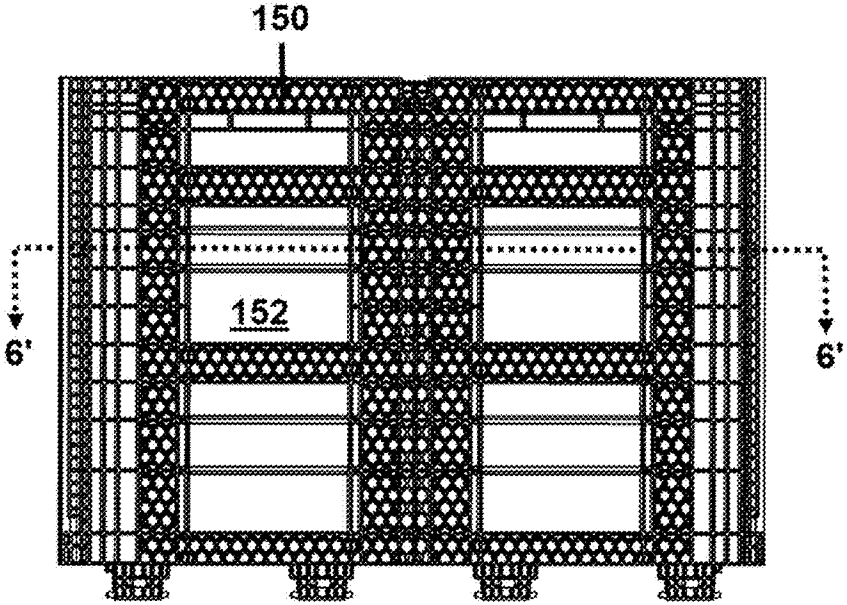
FIG. 15D is a front view of the of the external side of a second sidewall, according to multiple embodiments and alternatives.
Figure 15E:
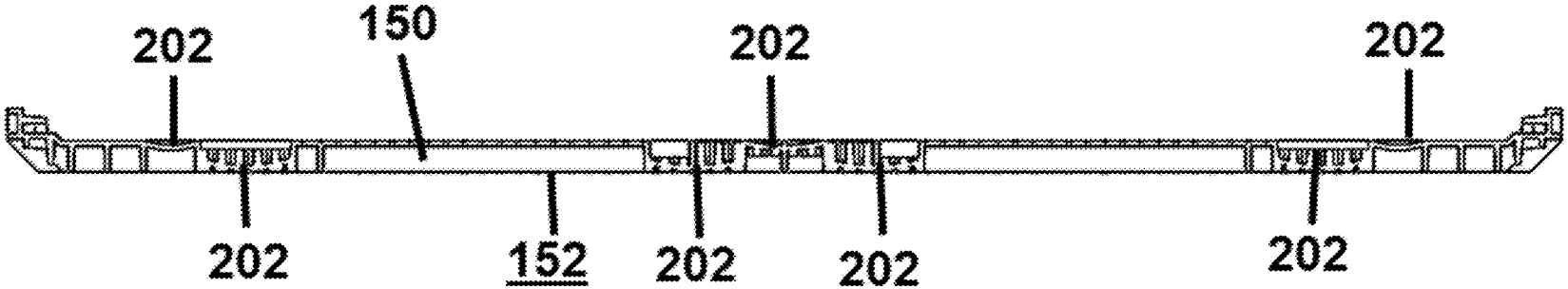
FIG. 15E is a cross-section view of a second sidewall, across line 6'-6' of FIG. 15D, according to multiple embodiments and alternatives.
Figure 15G:
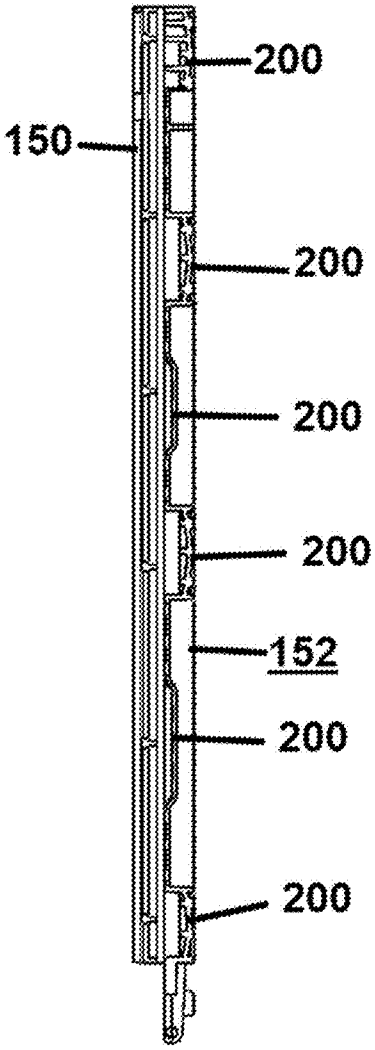
FIG. 15G is a cross-section view of a second sidewall, across line 7'-7' of FIG. 15F, according to multiple embodiments and alternatives.
Figure 15F:
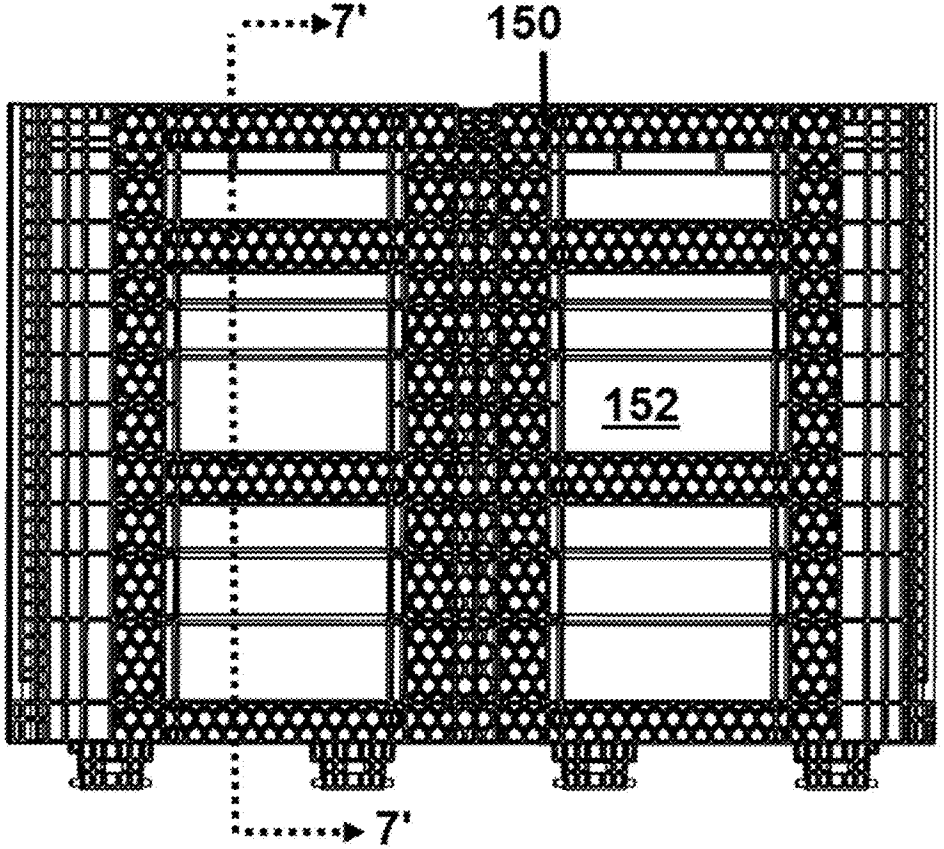
FIG. 15F is a front view of the external side of a second sidewall, according to multiple embodiments and alternatives.

As discussed in more detail below, in some embodiments a series of curved protrusions are positioned along the entire length of the sidewalls 85, 150. As shown in FIGS. 2A-2B, a series of curved horizontal protrusions 200 span horizontally along the sidewalls 85, 150 in parallel and spaced apart rows (as a non-limiting example). In further embodiments, a series of curved vertical protrusions 202 span vertically along the sidewalls 85, 150 in a series of parallel and spaced apart columns (as a non-limiting example). According to multiple embodiments and alternatives, the protrusions 200, 202 each curve in the same direction to control the buckling moment (e.g. a convex geometry on the outer surface 88 and a concave geometry on the inner surface 90 as non-limiting examples) as best illustrated in FIGS. 15E and 15G.

Figure 3A:
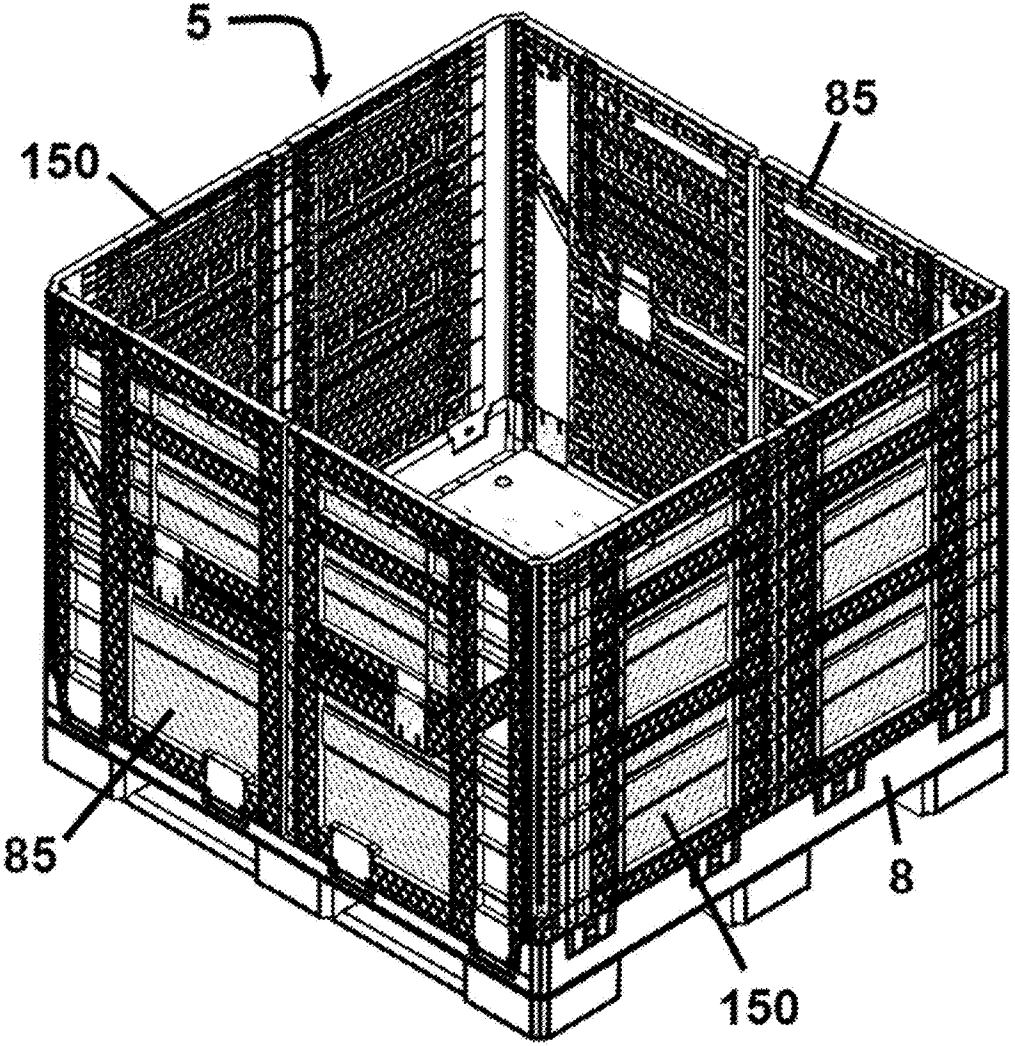
FIGS. 3A-3B are top, perspective views of a collapsible shipping container, according to multiple embodiments and alternatives.
Figure 3B:
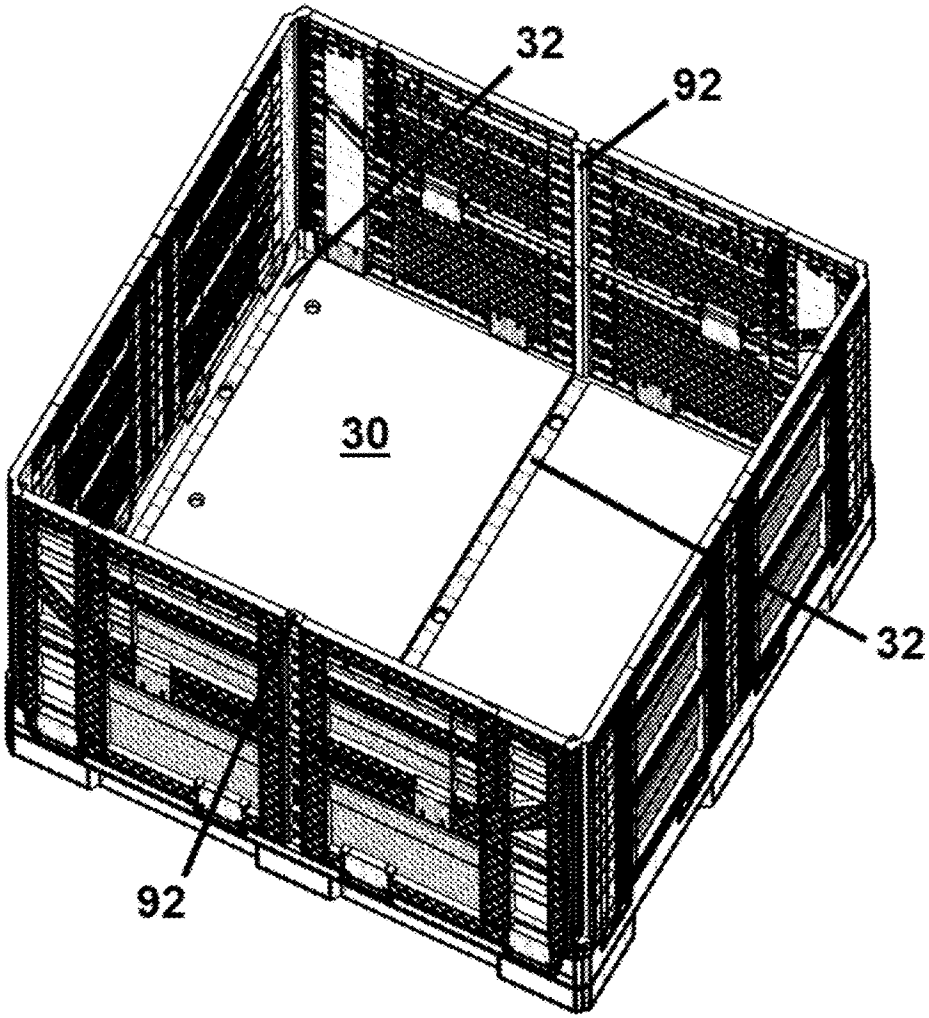
Figure 4:
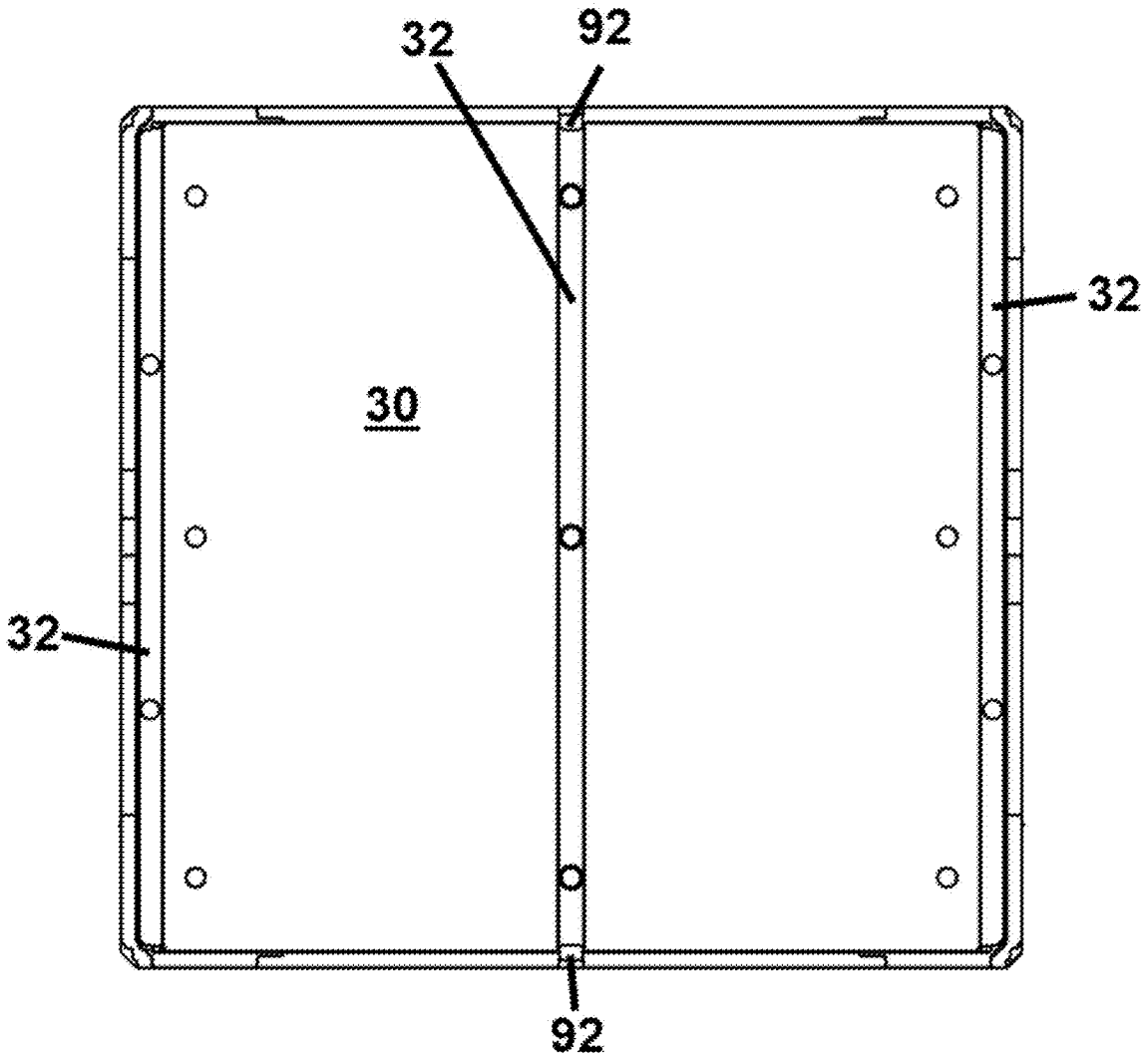
FIG. 4 is a plan view of a collapsible shipping container, according to multiple embodiments and alternatives.
Figure 5:
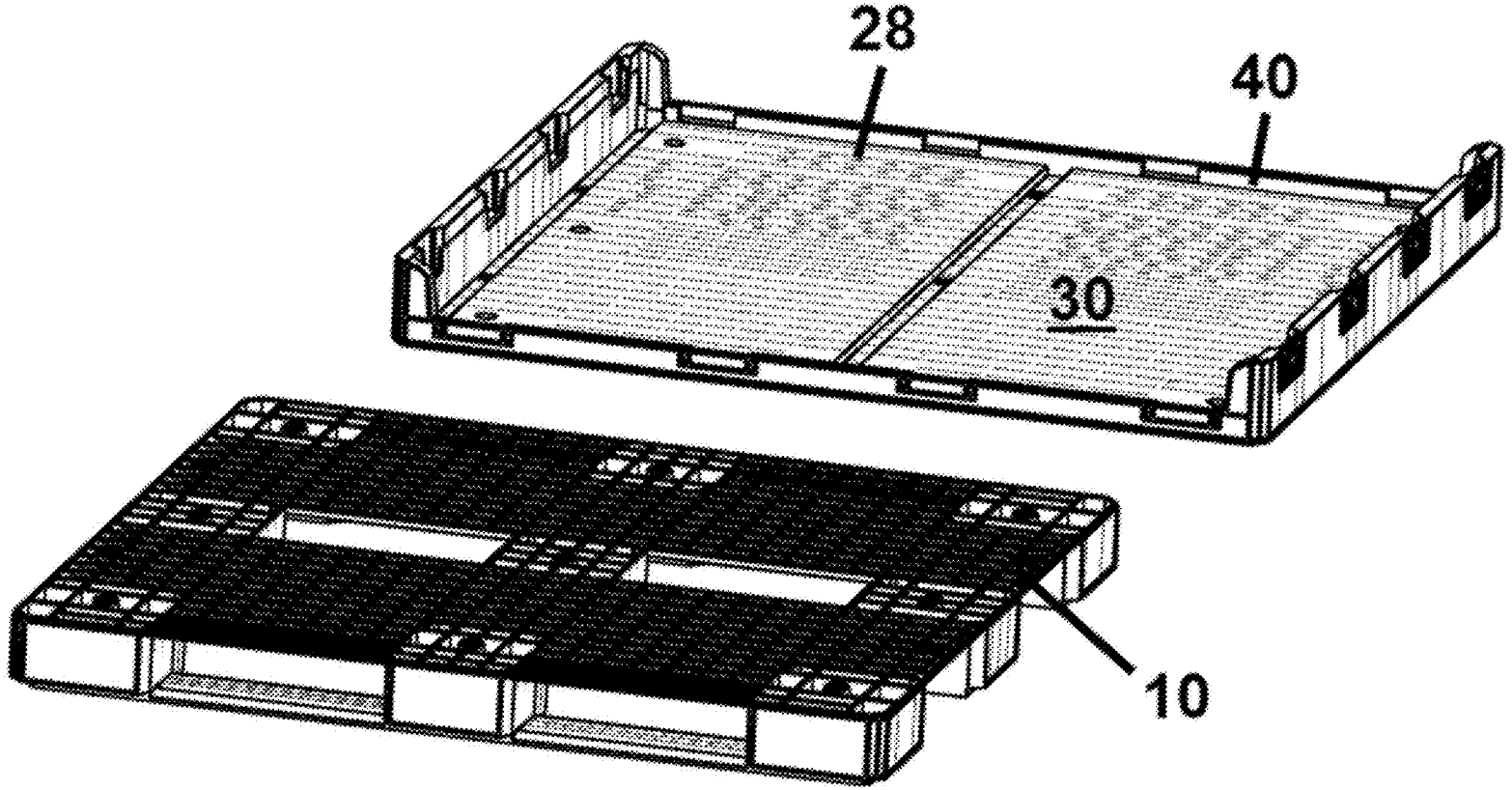
FIG. 5 is a perspective view of a base for a collapsible shipping container having a top member and a bottom member, according to multiple embodiments and alternatives.

As illustrated in FIGS. 3A-4, a vertical column 92 extends along the entire height of the middle portion of the inner surface 90 of the first pair of sidewalls 85. In further embodiments, a vertical column extends along the entire height of the middle of the inner surface 155 of the second pair of sidewalls 150. According to multiple embodiments and alternative, the vertical column 92 defines a corresponding slot on the outer surface of the first pair of sidewalls 85 which is adapted to receive the vertical column 92 of the other first sidewall when the first sidewalls are stacked on top of each other in the collapsed position (as shown in in FIG. 1E). FIG. 5 illustrates the base 8 having a bottom member 10 connected to a top member 28 (via welding as a non-limiting example), wherein the top member 28 defines a top surface 30 (i.e. the bottom of the container 5). In some embodiments, the top surface 30 further defines a series of recesses 32 which are adapted to receive the vertical column 92 and the wrap-around extensions 105 of either of the sidewalls 85 when said sidewalls 85 lay flat. As best illustrated in FIG. 4, a middle recess 32 is positioned along the middle of the top surface 30 of the bin and is adapted to receive the vertical column 92. In further embodiments, a pair of end recesses 32 are positioned along the ends of the top surface 30 and are adapted receive the wrap-around extensions 105. Accordingly, the middle and end recesses 32 enable the sidewalls 85 to lay flat when in the collapsed position.

Figure 6:
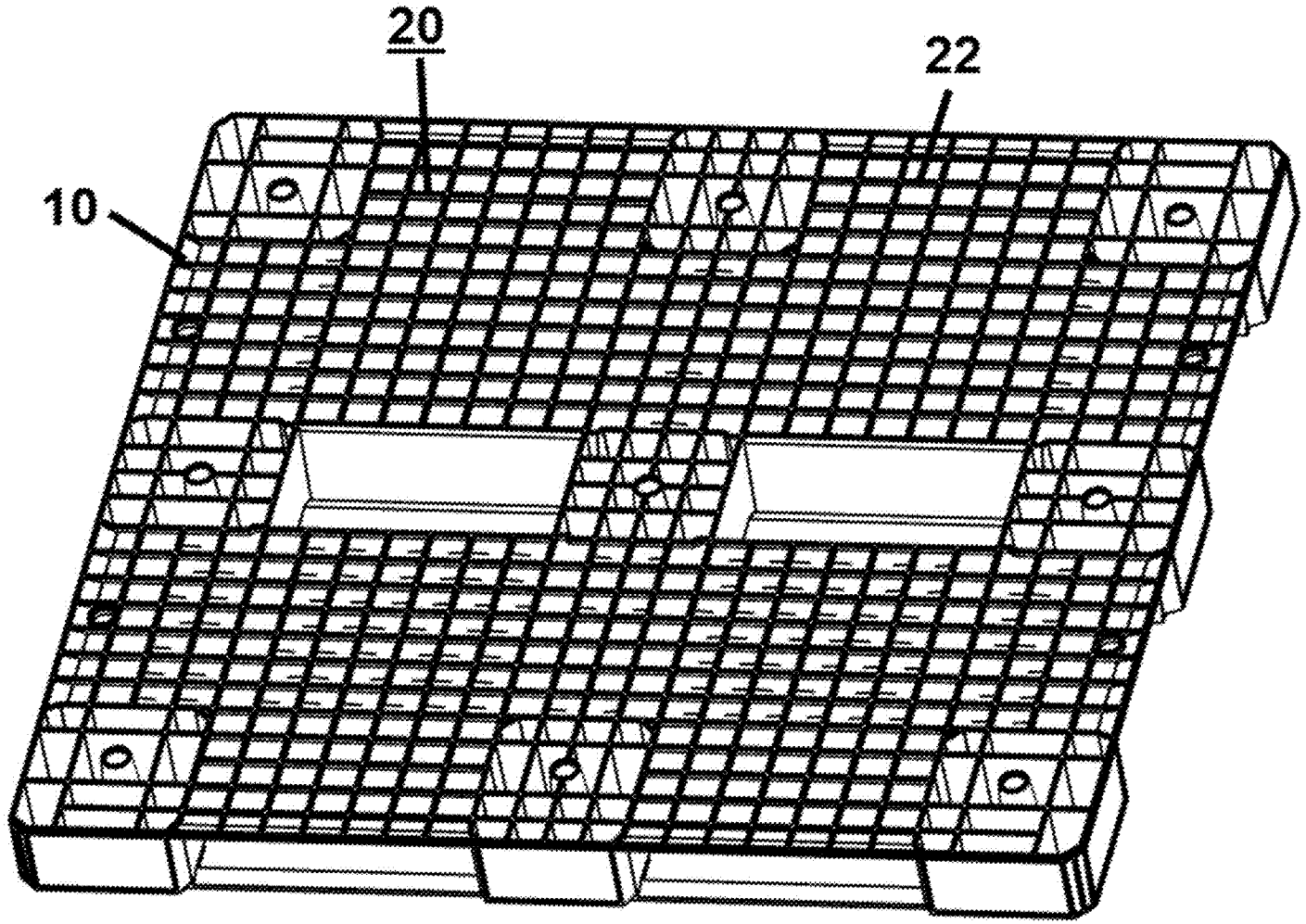
FIG. 6 is a top, perspective view of a bottom member of a base for a collapsible shipping container, according to multiple embodiments and alternatives.
Figure 7:
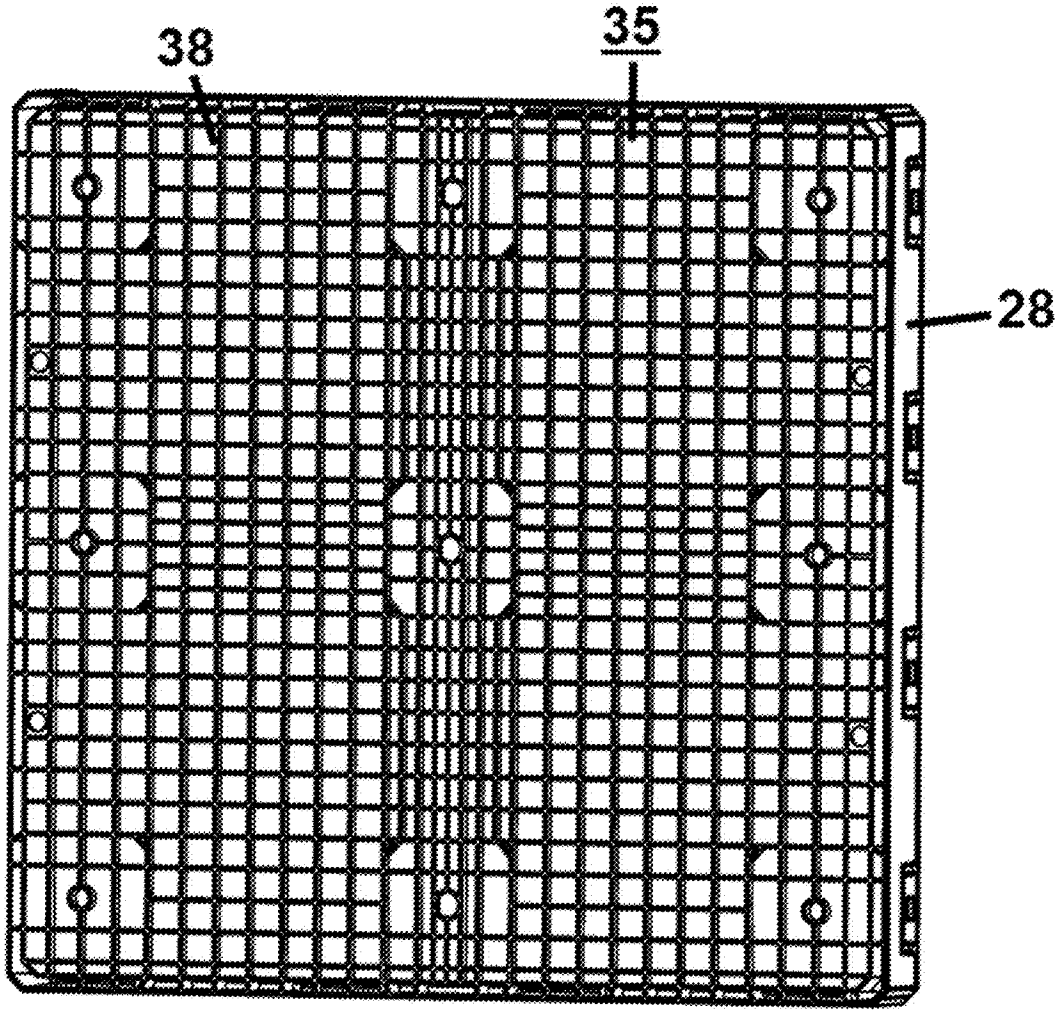
FIG. 7 is a bottom, perspective view of a top member of a base for a collapsible shipping container, according to multiple embodiments and alternatives.

According to multiple embodiments and alternatives, the top surface 20 of the bottom member 10 comprises a grid support structure 22 as illustrated in FIG. 6 and the bottom surface 35 of the top member 28 also defines a grid support structure 38 as illustrated in FIG. 7. In some embodiments, both grid support structures 22, 38 comprise a series of curved ribs which allows for the use of thinner and lighter materials in base 8 and provides stronger support for the container 5.

As shown in FIGS. 8-11B, in some embodiments the first pair of sidewalls 85 are pivotably connected to the first set of side rims 42 of the base rim 40 via one or more hinge members 60. In some embodiments, each of the hinge members 60 comprise an interior side 68, an exterior side 70 (having a grid support system (not numbered)), a top hinge 62, a bottom hinge 65 and a pair of grooves 72 that extend down from the top of the hinge member 60. It will be appreciated that the grooves 72 permit the top hinge 62 to be removably secured to, and removed from, the top hinge borings 102 of the first pair of sidewalls 85 by squeezing the hinges 62 together and engaging the top hinge borings 102. In turn, the bottom hinge 65 of the hinge members 60 are pivotably connected to the hinge member slots 45 which are defined by the first set of side rims 42 of the base rim 40.

Figure 8:
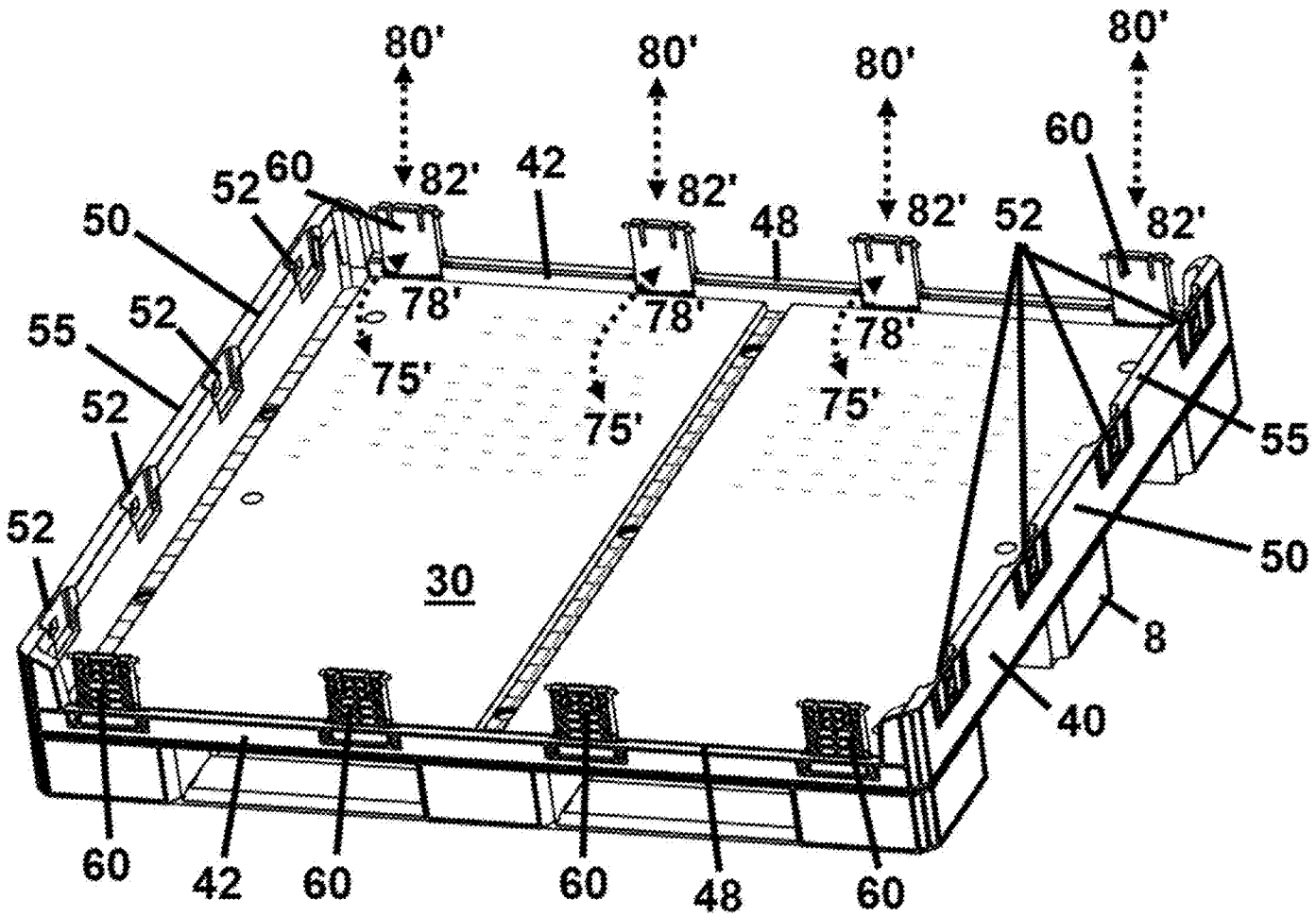
FIG. 8 is a perspective view of a base and a series of hinge members for a collapsible shipping container, according to multiple embodiments and alternatives.
Figure 9A:
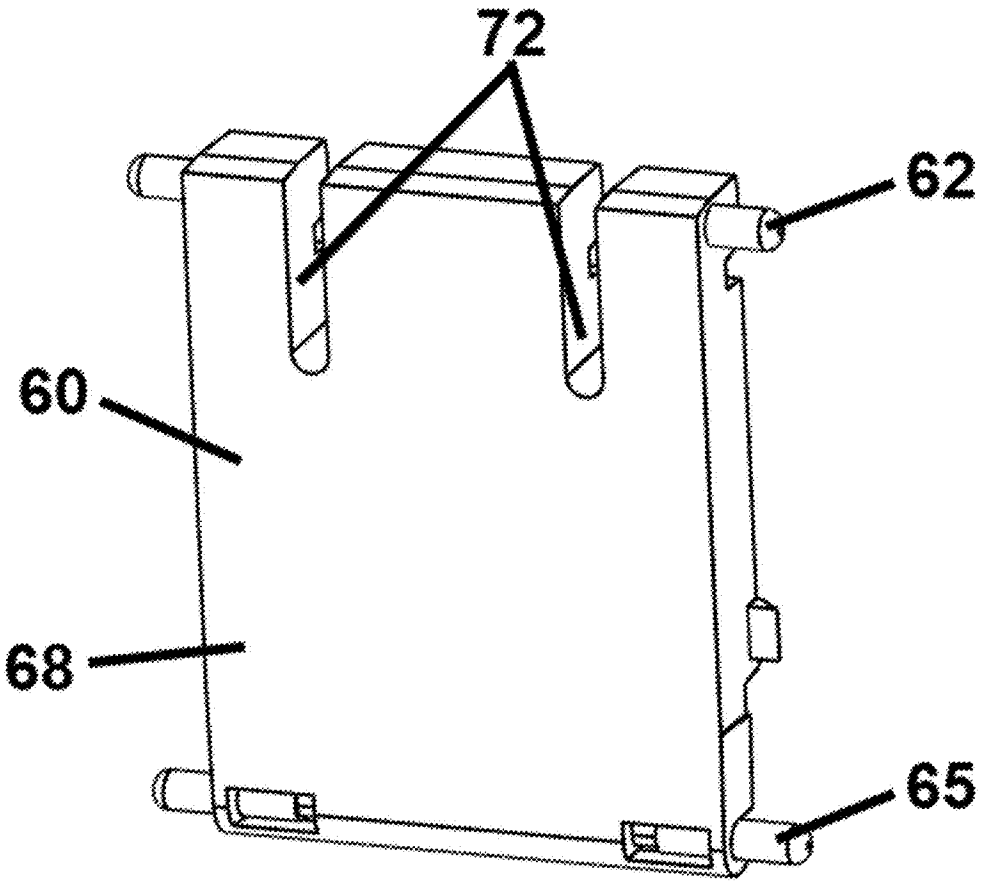
FIG. 9A is a perspective view of the internal side of a hinge member, according to multiple embodiments and alternatives.
Figure 9B:
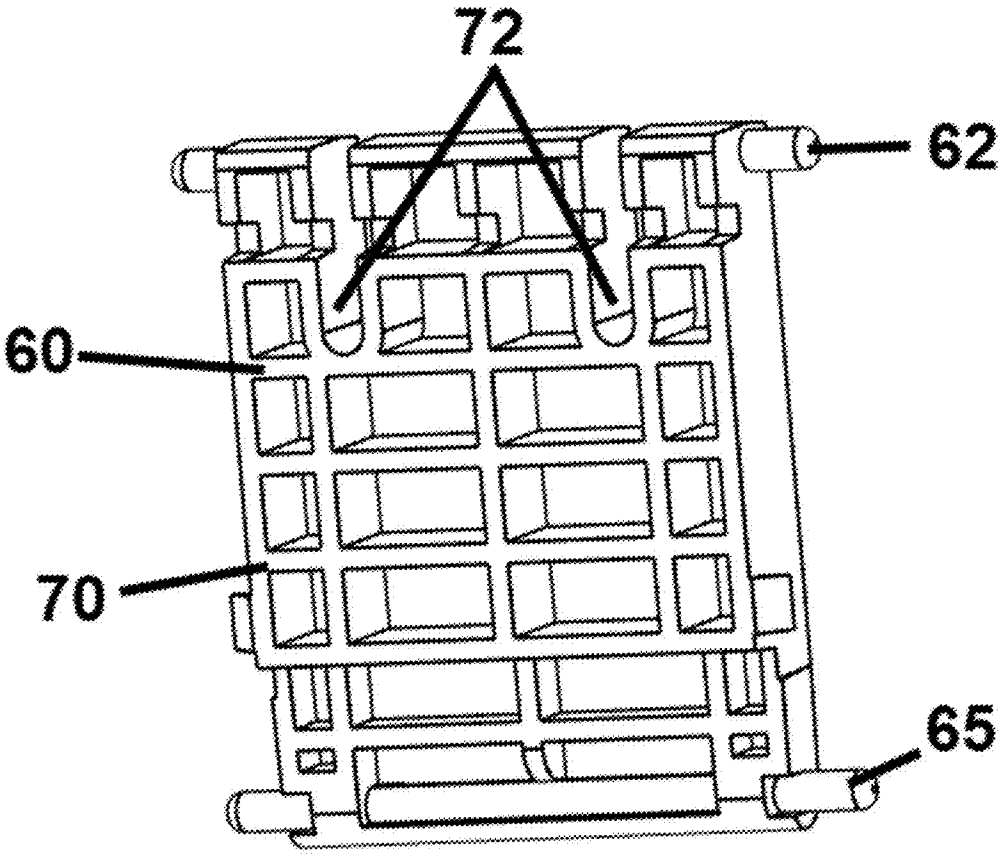
FIG. 9B is a perspective view of the external side of a hinge member, according to multiple embodiments and alternatives.
Figure 10:
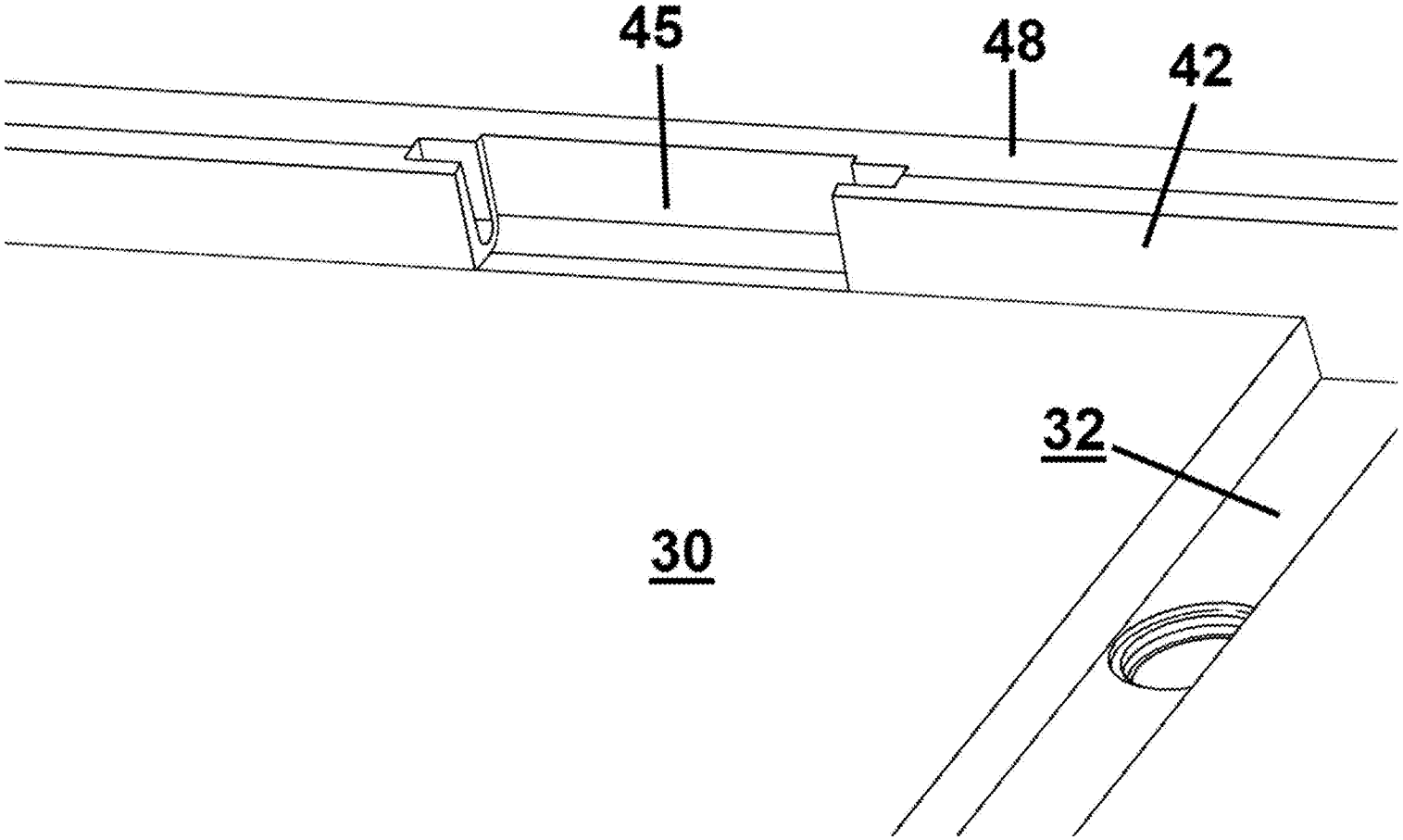
FIG. 10 is a perspective view of a hinge member slot in a base rim of a collapsible shipping container, according to multiple embodiments and alternatives.
Figure 11A:
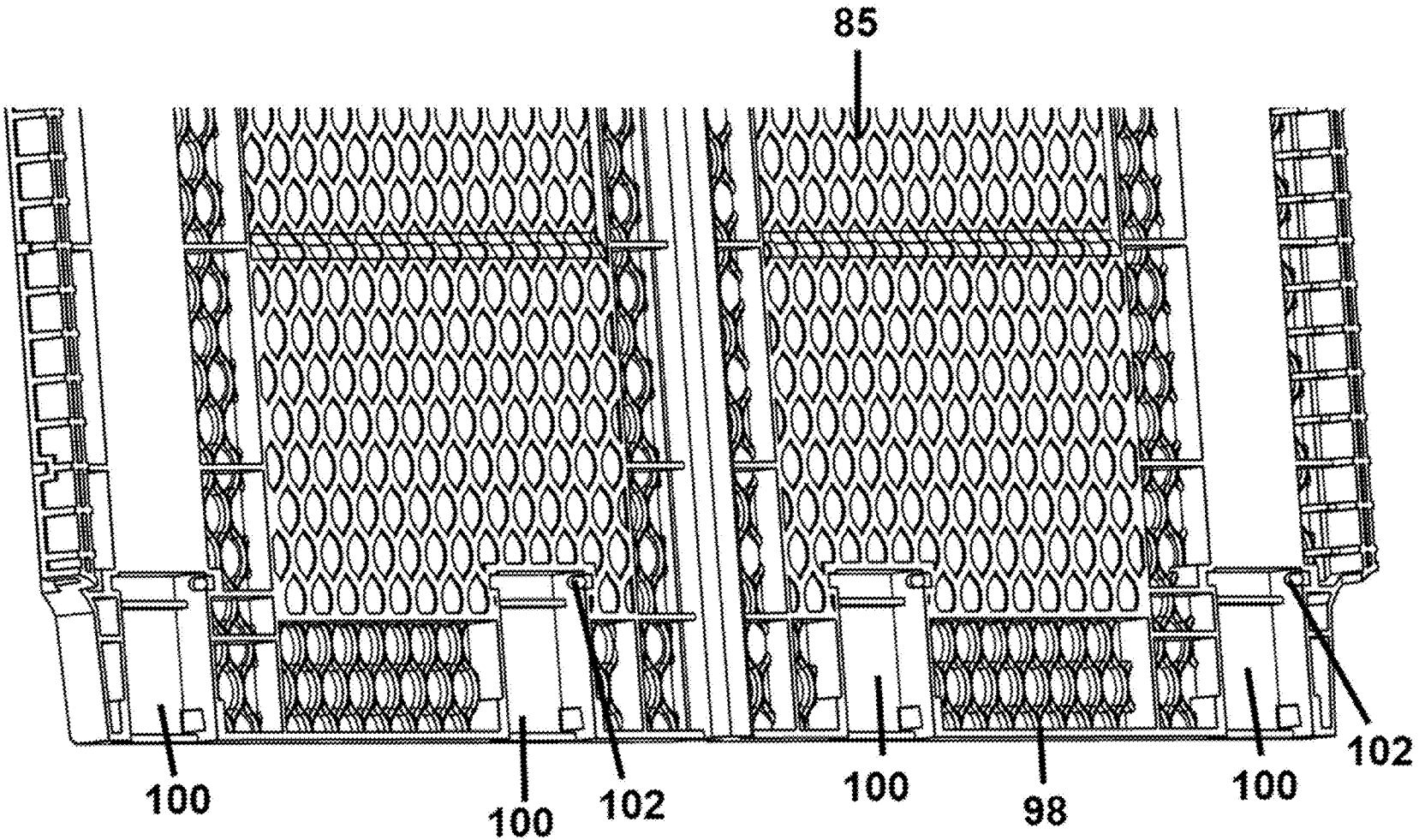
Figure 11B:
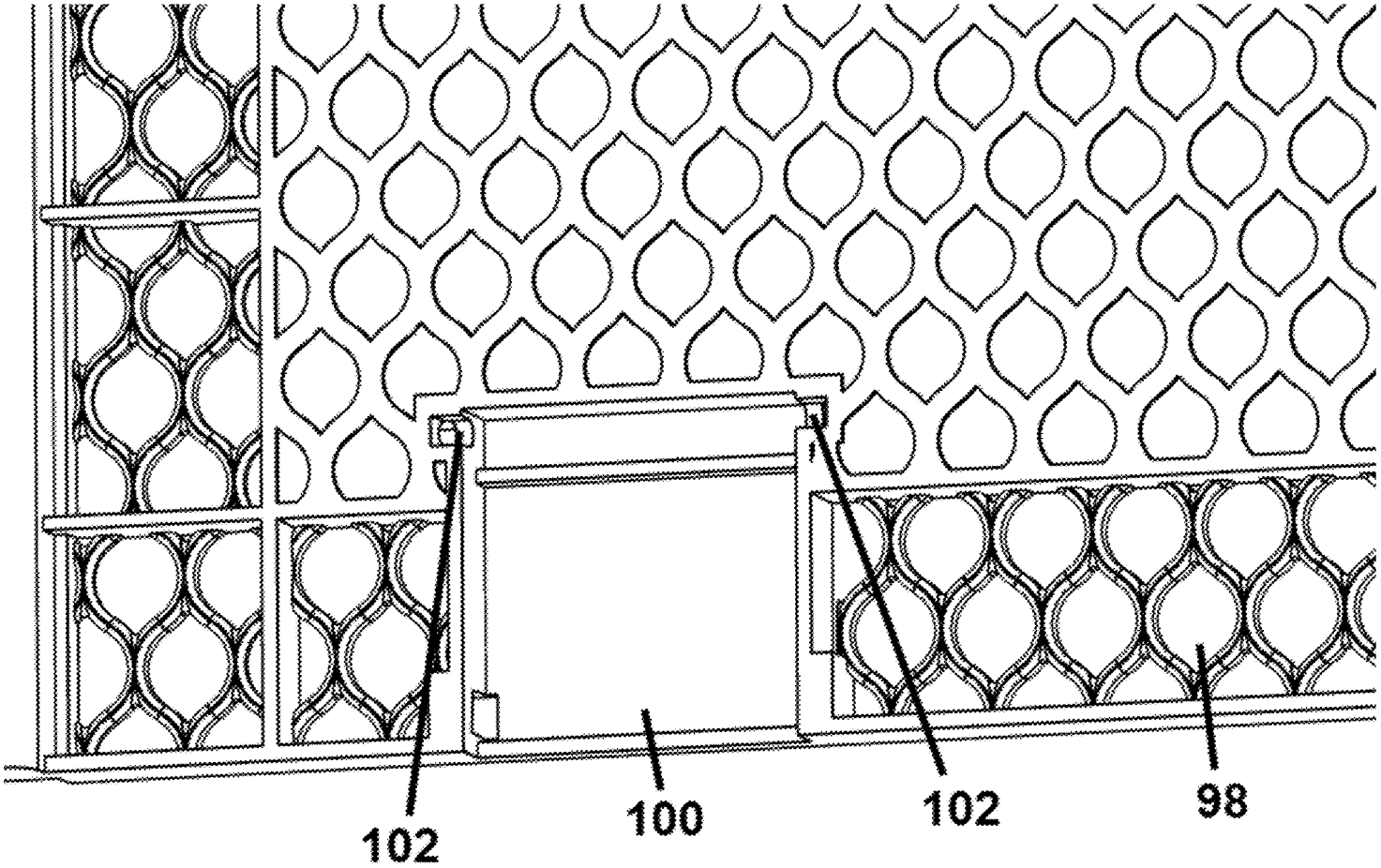

Accordingly, and as best illustrated in FIG. 8, the bottom hinge 65 is adapted to move vertically within hinge member slot 45 either up along arrow 80' or down along arrow 82'. In turn, as the bottom hinge 65 moves vertically, the top hinge 62 rotates downward towards the bottom of the bin 30 along arrow 75' or upwards along arrow 78'. As shown in FIGS. 11A-11B, the first pair of sidewalls 85 define a series of hinge member recesses 100 positioned along the bottom edge 98 which are adapted to pivotably receive a portion of a hinge member 60. In some embodiments, each of the hinge member recesses 100 further define top hinge borings 102 which are adapted to pivotably receive the top hinge 62. Accordingly, the hinge members 60 enable the first pair of sidewalls 85 to pivotably engage the base 8 and lay flat upon the top surface 30 such that the outer surface 88 is flush with the top edge 48 of the first set of side rims 42 of the base rim 40 (best illustrated in FIG. 10) when in the collapsed position.

Figure 12A:
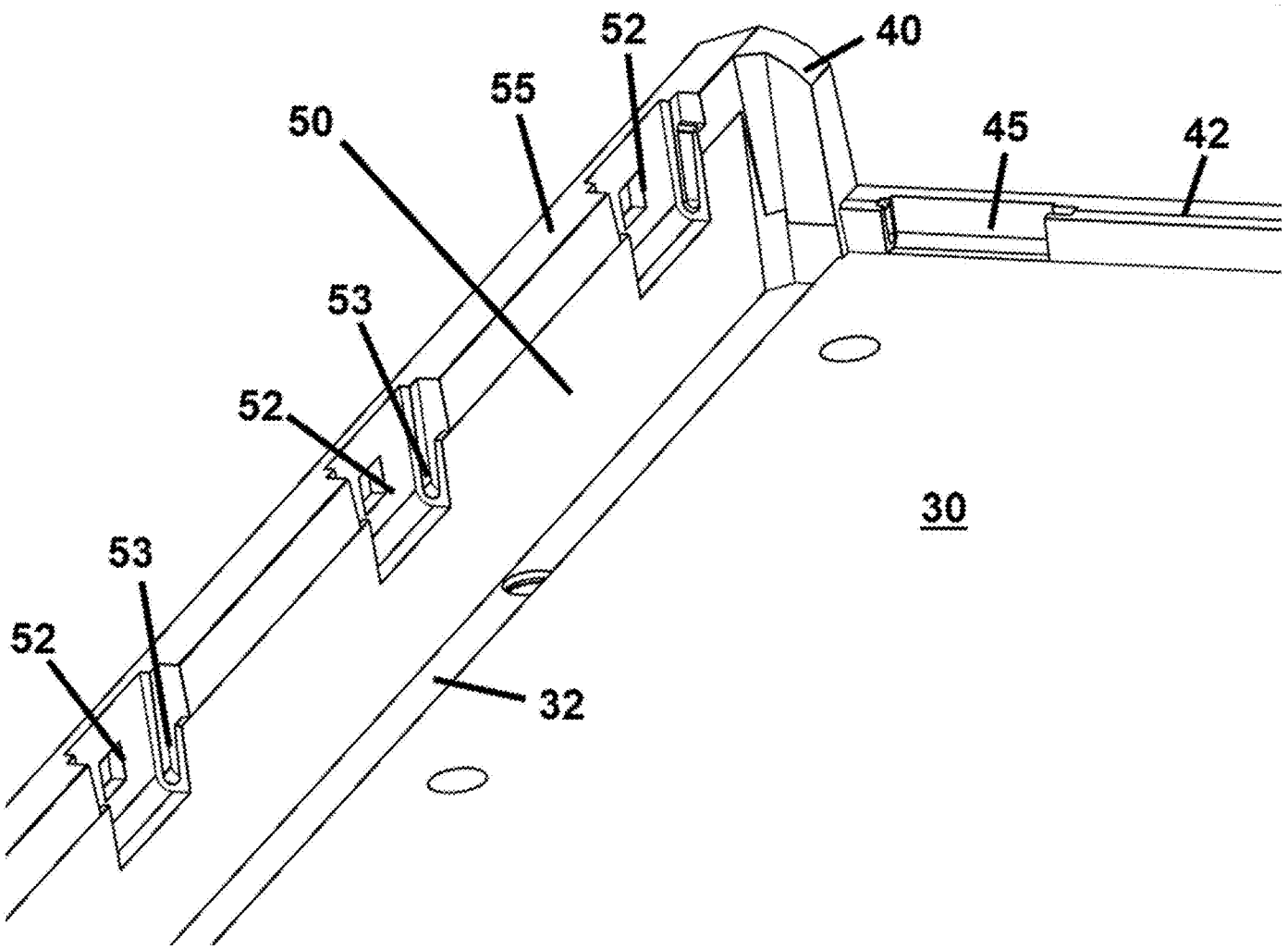
FIG. 12A is a perspective view of a base rim for a collapsible shipping container, according to multiple embodiments and alternatives.
Figure 12B:
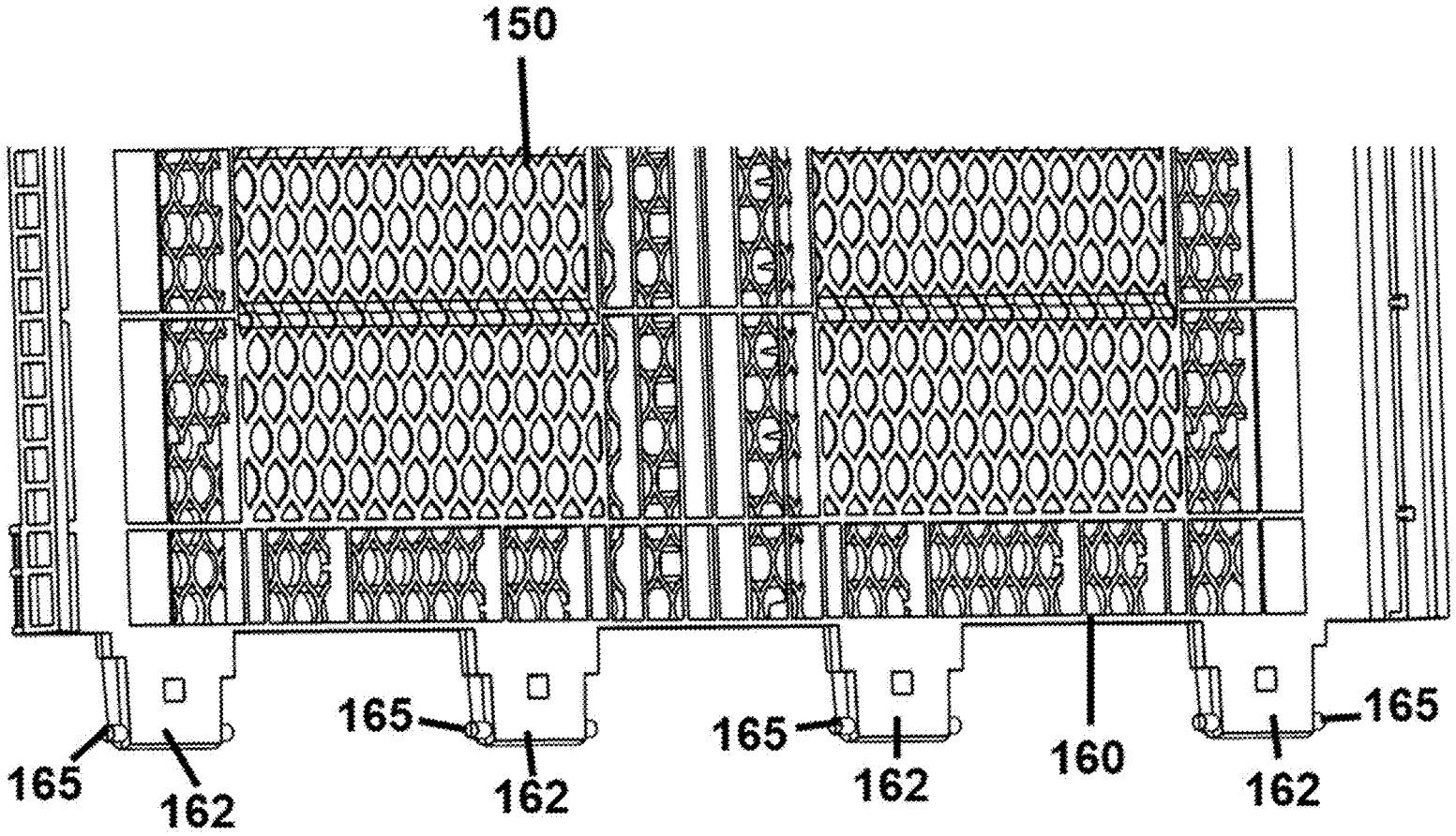
FIG. 12B is a perspective view of a portion of a second pair of sidewalls, according to multiple embodiments and alternatives.

As illustrated in FIGS. 8 and 12A-12B, the base rim 8 further comprises a second pair of opposing side rims 50 which define a plurality of hinge unit recesses 52 having slots 53, wherein the recesses 52 are adapted to pivotably receive the hinge units 162 of the second pair of sidewalls 150. The plurality of hinge units 162 extend downward from the bottom edge 160 of the second pair of sidewalls 150 and further comprise a hinge 165 which is adapted to be pivotably received in the slots 53 of the hinge unit recess 52. Accordingly, the hinge unit recesses 52 permit the second pair of sidewalls 150 to rotate from the upward position and downward to the collapsed position, and vice versa. Unlike the first pair of sidewalls 85, the outer surface 152 of the second pair of sidewalls 150 are positioned below the top edge 55 (best shown in FIG. 12A) when in the collapsed position. As previously noted, in some embodiments this feature allows the top edge 55 to be received in the grooves 26 of the bottom of another bin which permits the container 5 to stack.

Figure 13:
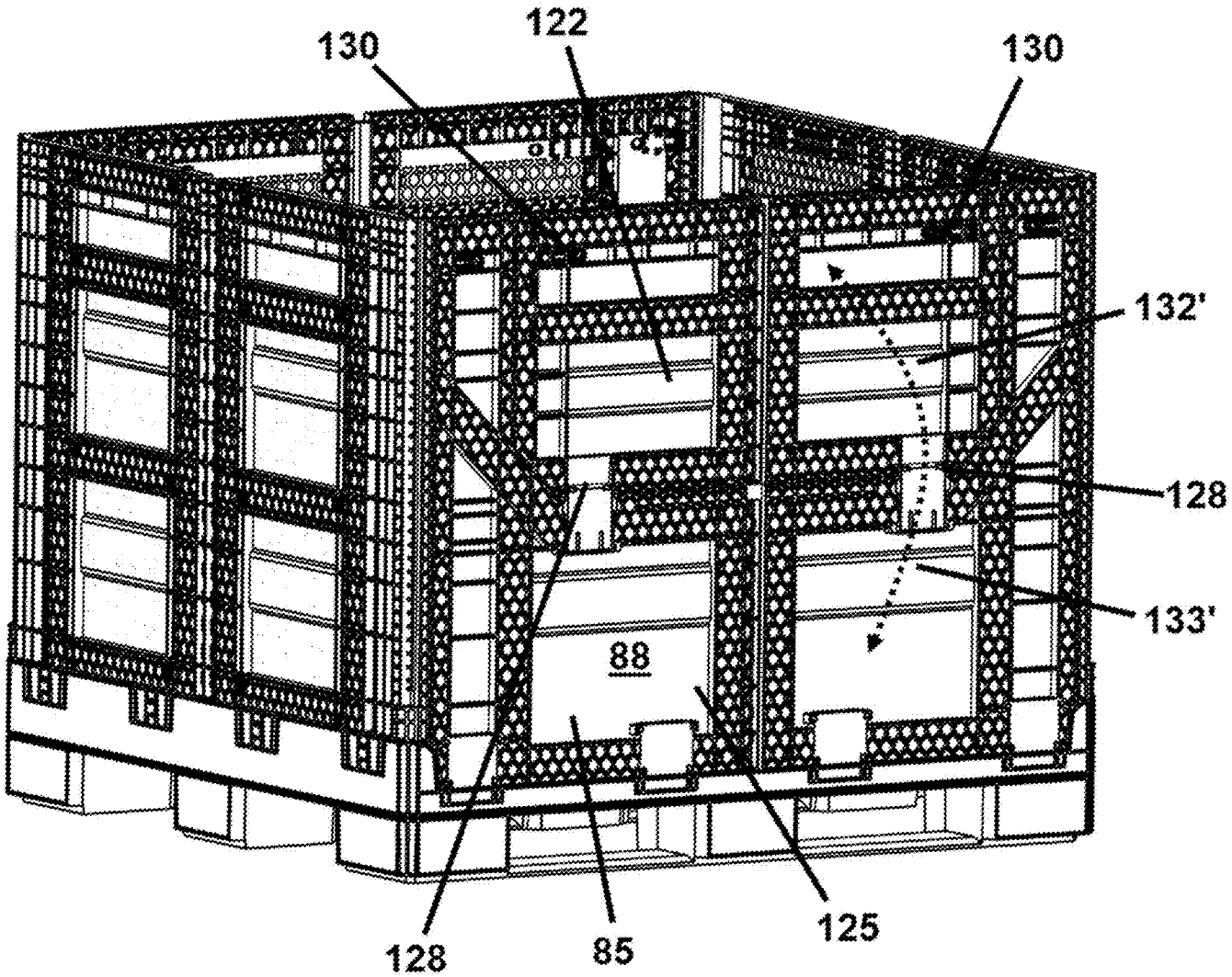
FIG. 13 is a perspective view of a collapsible shipping container having at least one drop-down door, according to multiple embodiments and alternatives.
Figure 14:
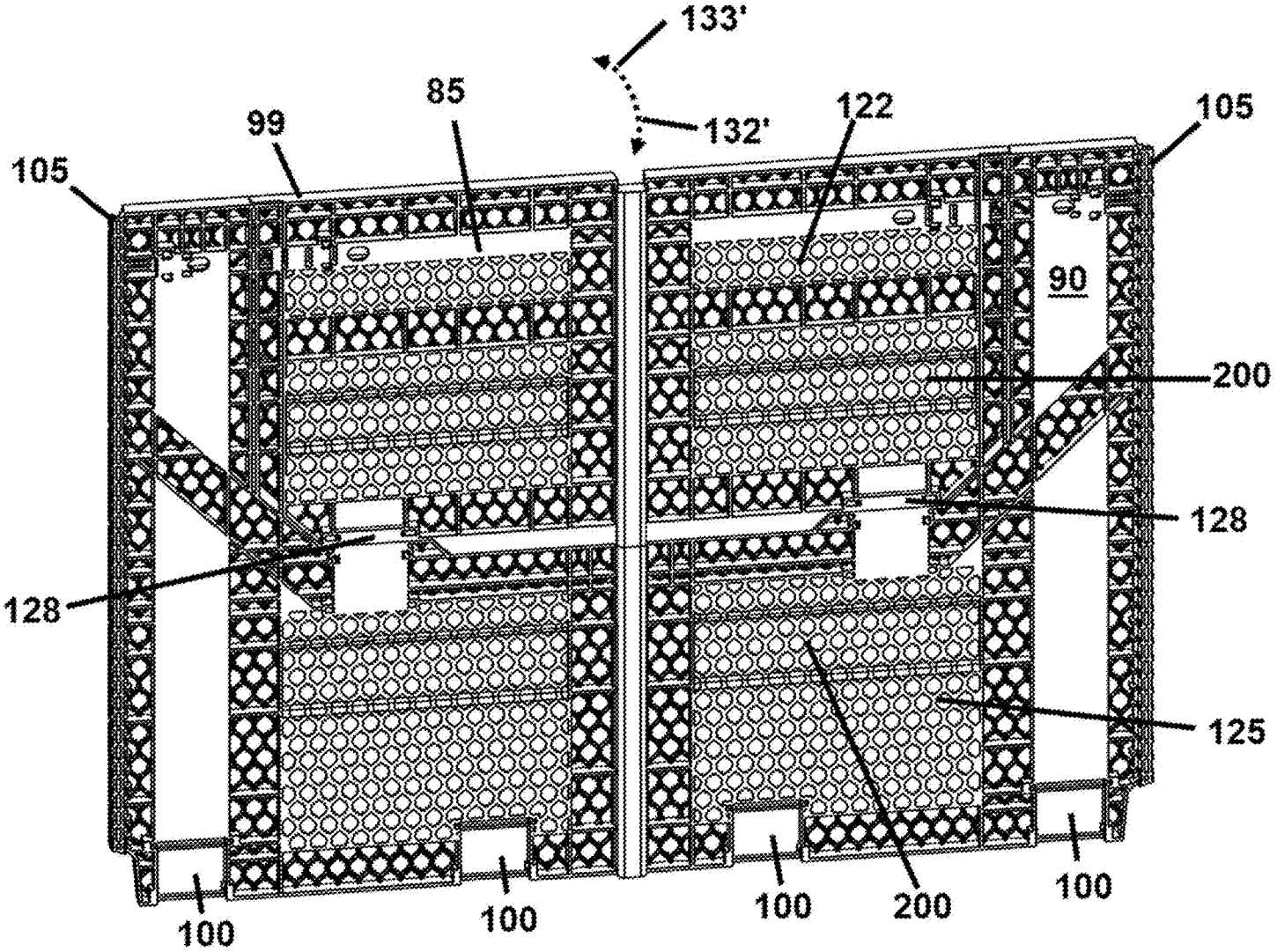
FIG. 14 is a perspective view of an internal side of a first sidewall, according to multiple embodiments and alternatives.

According to multiple embodiments and alternatives, as shown in FIG. 13 the container 5 may comprise an optional drop-down door feature in which a drop-down door 122 can rotate downward along arrow 133' or upward along arrow 132' from one or more of the sidewalls (or none of the sidewalls, if desired by the user). As illustrated in FIGS. 13A-14 and 16A-16B, the first sidewall 85 (or one or more of sidewalls 150) may comprise a main member 125 and a drop-down door 122 which is pivotably connected to main member 125 via at least one hinge 128. In some embodiments, a user may disengage the drop-down door 122 from the main member 125 by sliding latch 130 inward and then rotating the drop-down door downward along arrow 133' towards the outer surface 88. Likewise, the user can rotate the drop-down 122 along arrow 132' and re-engage the main member 125 via latch 130. It will be appreciated that the drop-down door 122 can be connected to the main member 125 via other latches and connections known to one of ordinary skill in the art, such as spring latches, pull latches, a door-handle configuration, and others.

As illustrated in FIGS. 14-15G and 2A-2B, in some embodiments a series of curved protrusions are positioned along the entire length and/or the entire height of the sidewalls 85, 150. According to multiple embodiments and alternatives, the sidewalls 85, 150 each define a series of curved horizontal protrusions 200 having a convex geometry on the outer surface 88 and a concave geometry on the inner surface 90 as non-limiting examples, span the entire length of the sidewalls from one side edge to the opposing side edge, and are positioned in parallel and spaced apart rows. As best illustrated in FIGS. 15A-15B, 15D-15E, and 2B, in some embodiments the sidewalls 85, 150 each define a series of curved vertical protrusions 202 having a convex geometry on the outer surface 88 and a concave geometry on the inner surface 90 as non-limiting examples, span the entire height of the sidewalls from the top edge to the bottom edge, and are positioned in parallel and spaced apart columns. It will be appreciated that the protrusions 200, 202 each curve in the same direction in order to control the buckling moment for the sidewalls 85, 150. In further embodiments, all of the protrusions 200, 202 curve outwardly and have a concave geometry (as a non-limiting example).

Figure 16A:
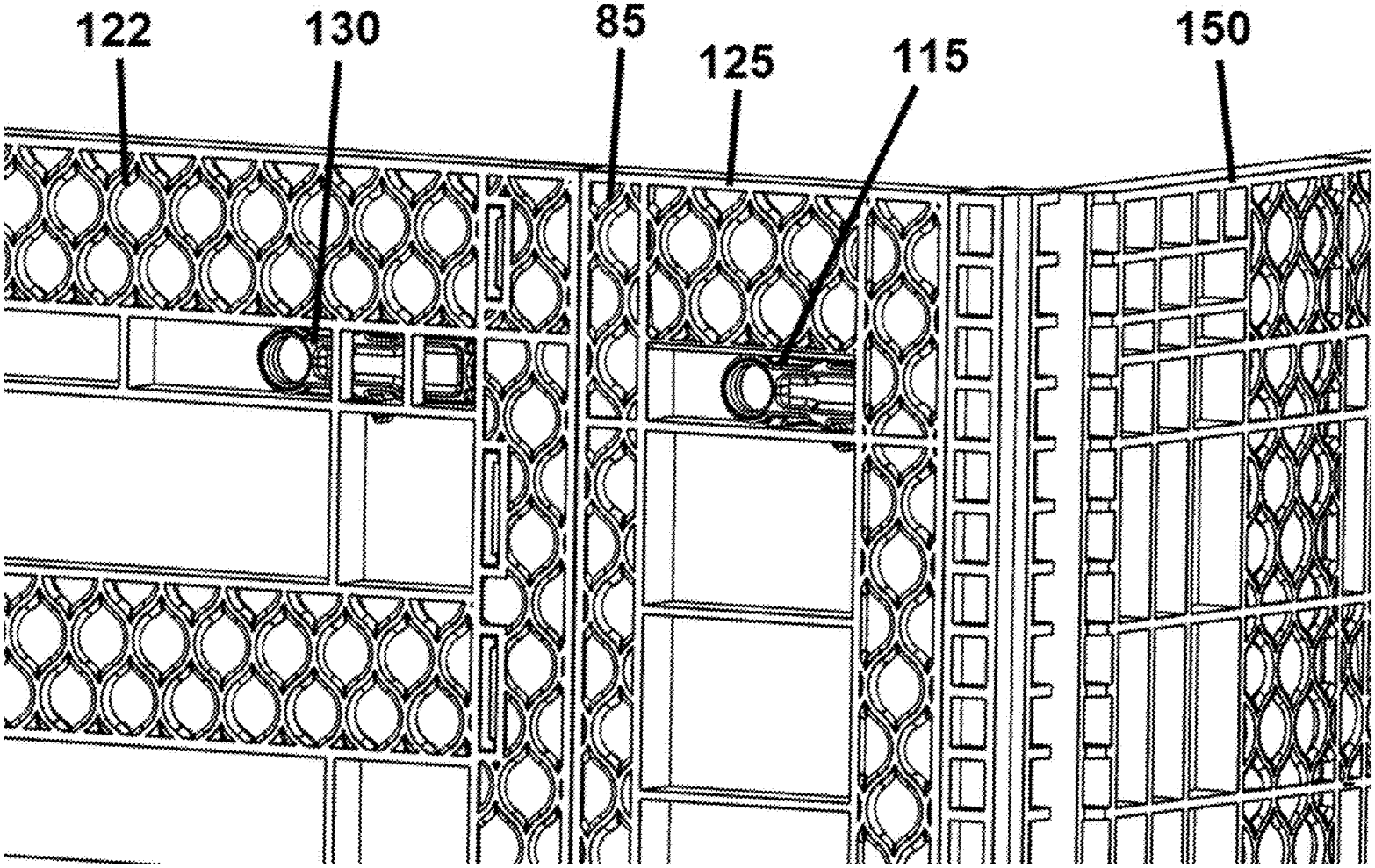
FIGS. 16A-16B are perspective views of at least one latch for a first sidewall, according to multiple embodiments and alternatives.
Figure 16B:
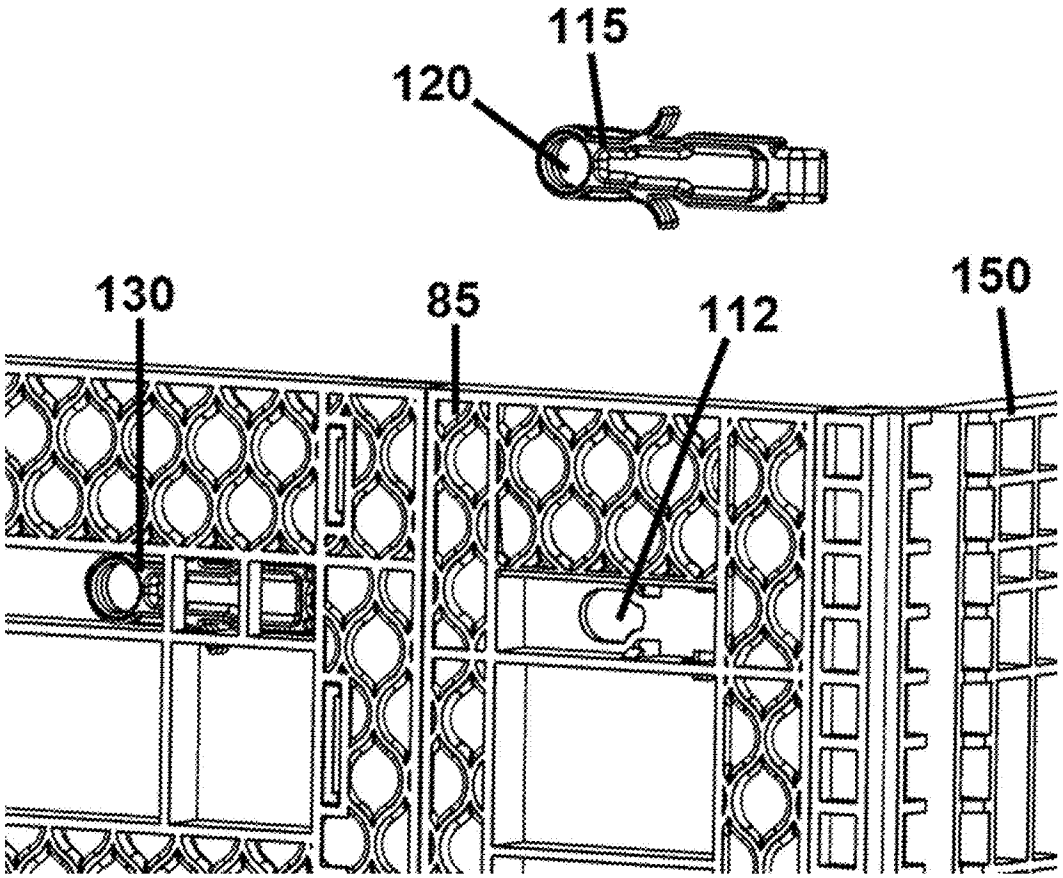

According to multiple embodiments and alternatives, the sidewalls 85, 150 are connected to one another by at least one latch 115. As best illustrated in FIGS. 16A to 16B, the outer surface of the sidewalls 85, 150 define one or more latch borings 112 which are adapted to slidably receive at least one latch 115. The latch borings 112 may also define a finger hole which spans through the sidewall and permits a user to use their finger to slidably engage a corresponding finger hole 120 in the latch 115. When a user desires to disengage the sidewalls 85, 150 from one another, a user can simply engage the latch 115 with their finger and slide the latch 115 inward. Once the latches 115 are disengaged, the user can begin rotating the sidewalls downward into the collapsed position as previously discussed.

Figure 17A:
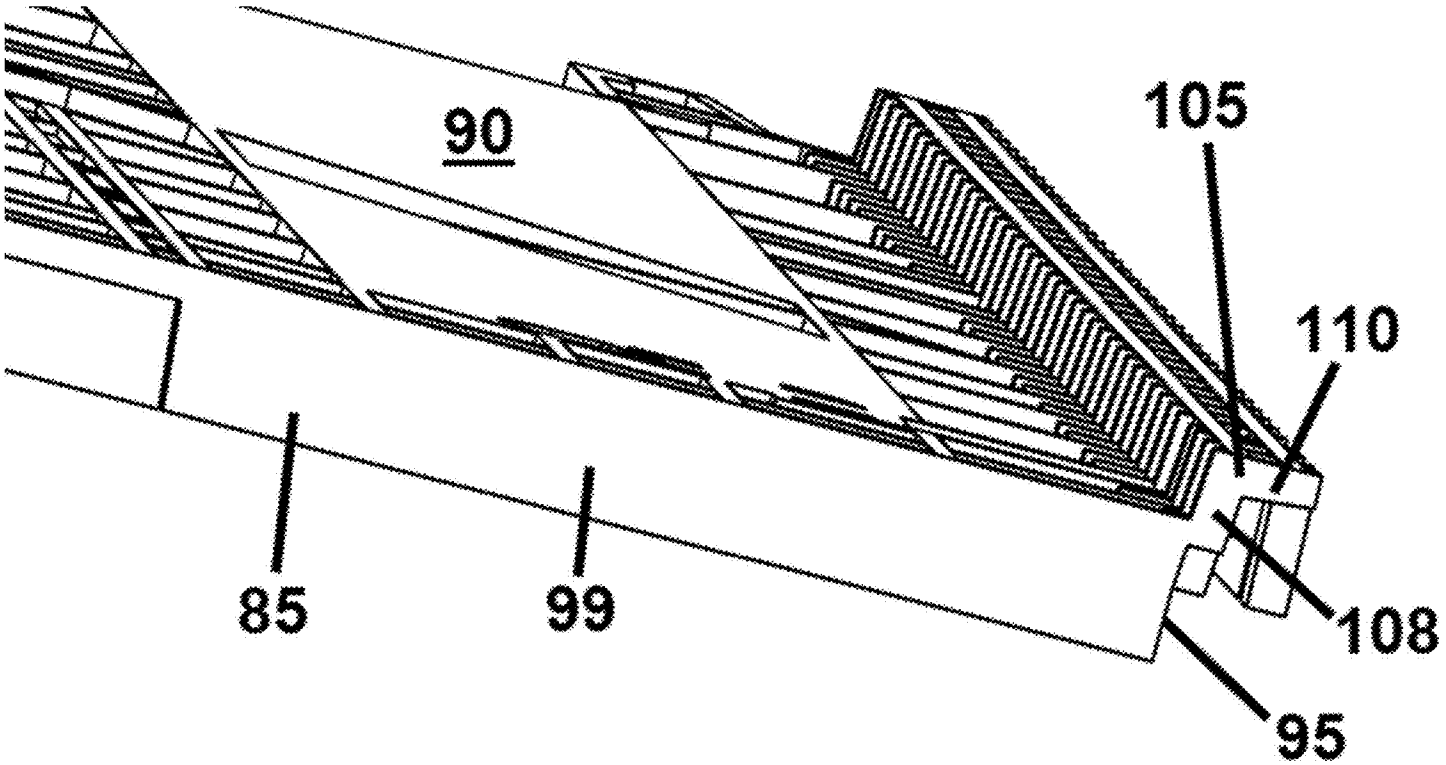
FIGS. 17A-17C are top, perspective views of a wrap-around extension for a first sidewall, according to multiple embodiments and alternatives.
Figure 17B:
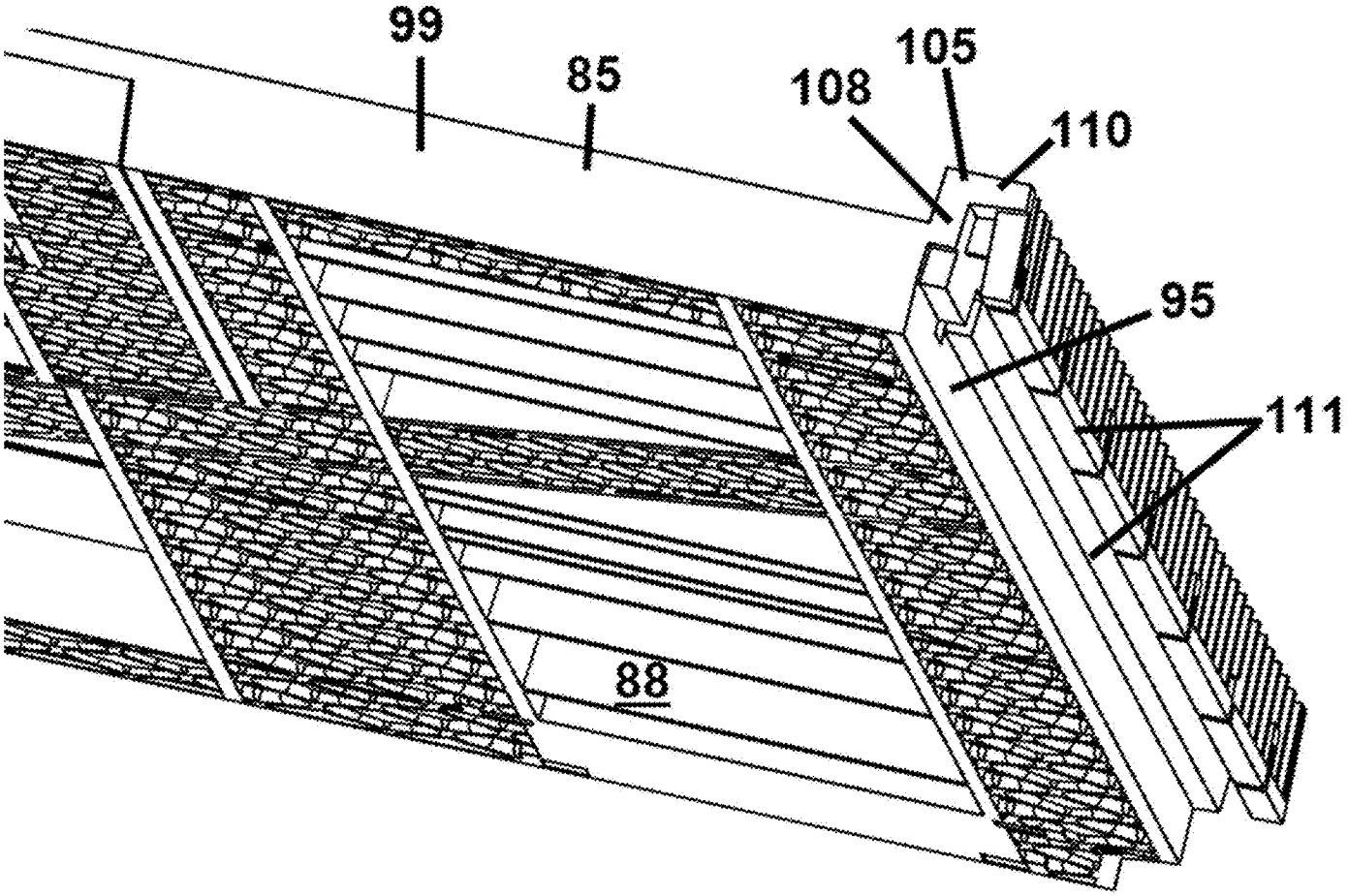
Figure 17C:
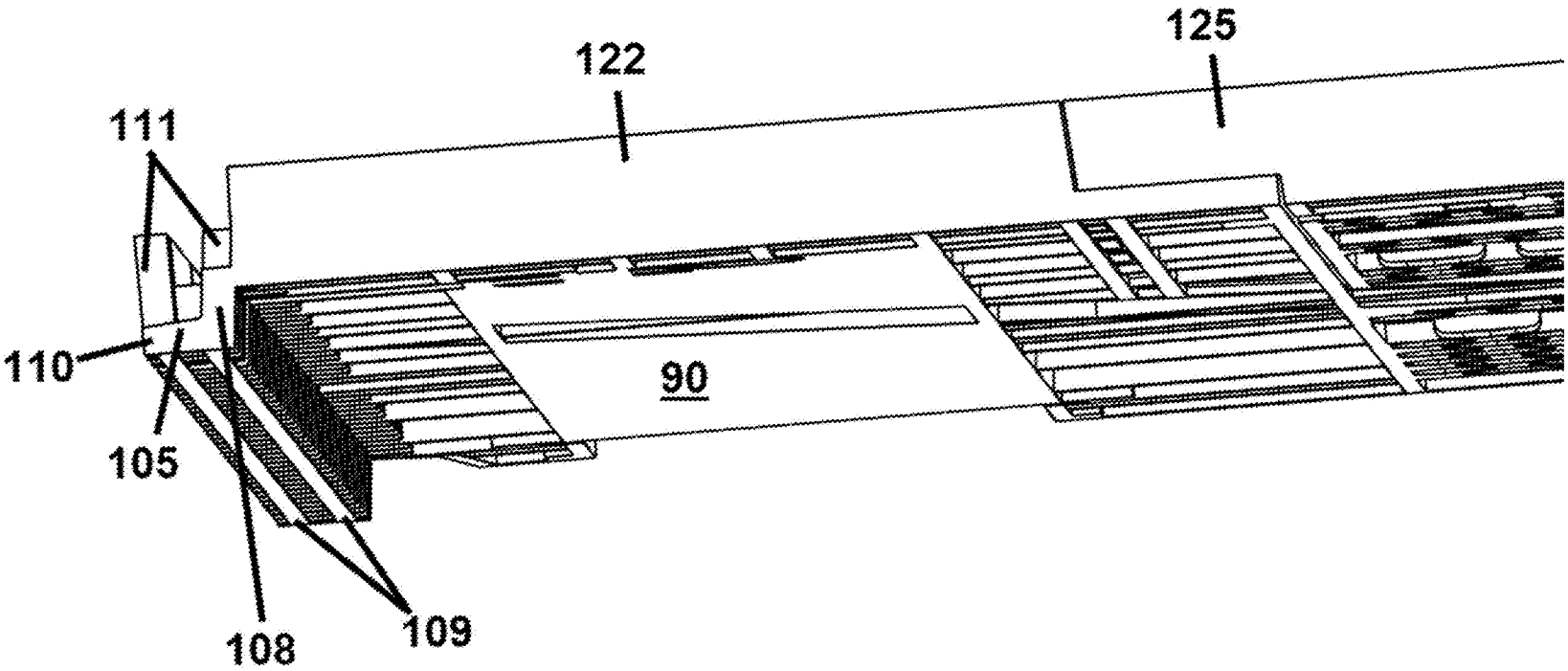

FIGS. 17A-19C illustrate the interlock between the wrap-around extension 105 (which generally comprises an "L-shape" as a non-limiting example) of the first pair of sidewalls 85 and the corresponding receiving extension 168 of the second pair of sidewalls 150. As shown in FIGS. 17A to 17C, a wrap-around extension 105 extends from the intersection of each of the side edges 95 and the inner surface 90 of each of the first pair of sidewalls 85 and is flush with the top edge 99. In some embodiments, the wrap-around extension 105 comprises a first component 108 integrally connected to a second component 110, wherein the first component 108 extends inward and the second component 110 extends outward. In further embodiments, the first and second components 108, 110 generally define a two-hundred and seventy (270) angle which extends along the entire height of the inner surface 90 of the first pair of sidewalls 85. As best illustrated in FIG. 17B, in some embodiments the wrap-around extension 105 further comprises a pair of external support columns 111 which extend vertically along the entire height of the external side of the wrap-around extension 105. As shown in FIG. 17C, in further embodiments a pair of internal support columns 109 span the entire height of the internal side of the wrap-around extension 105 along the second component 110. According to multiple embodiments and alternatives, support rows (not numbered) extend horizontally along the sides of the wrap-around extension 105 to provide additional support.

Figure 18A:
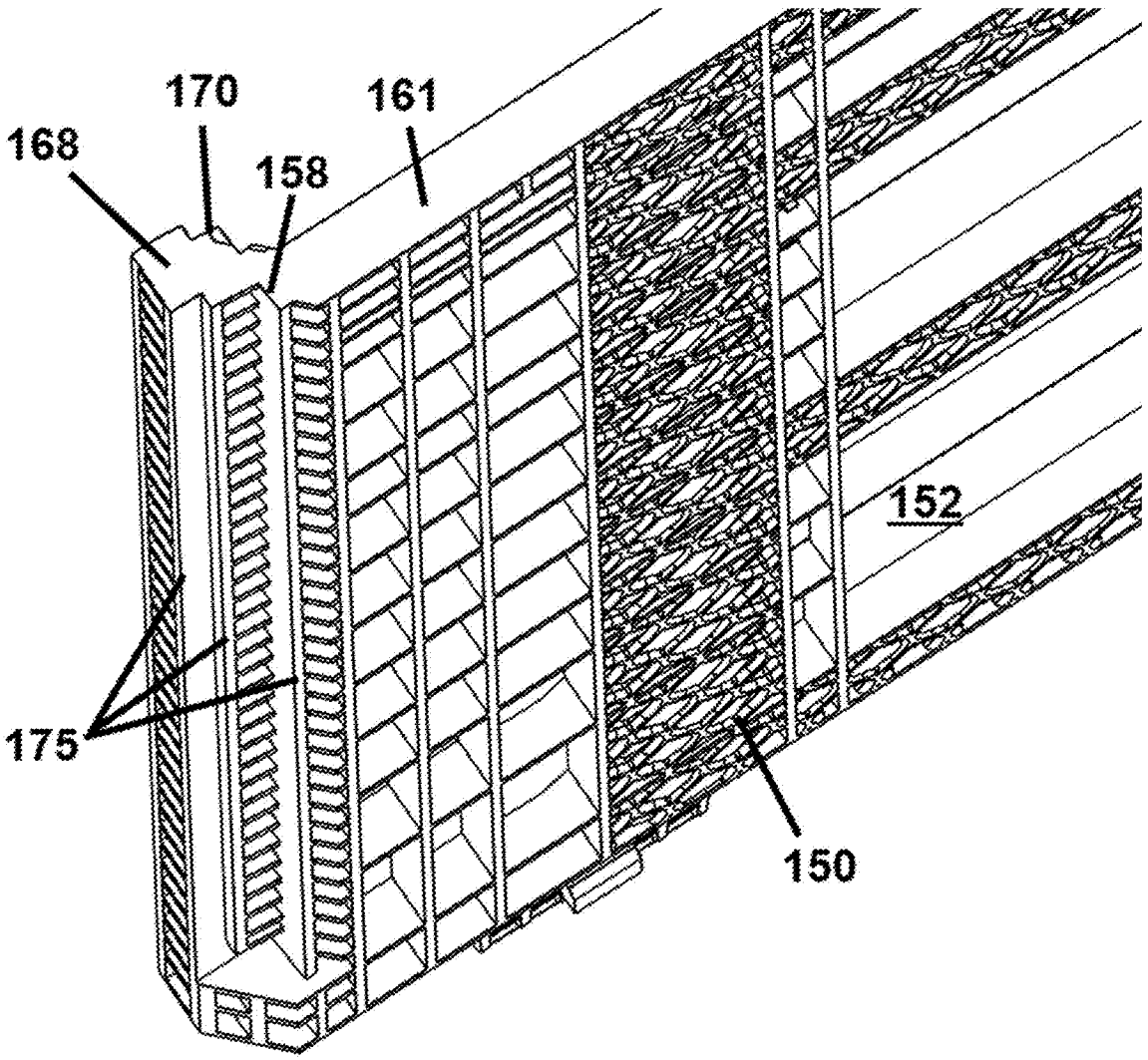
FIG. 18A-18B are top, perspective views of a receiving extension for a second sidewall, according to multiple embodiments and alternatives.
Figure 18B:
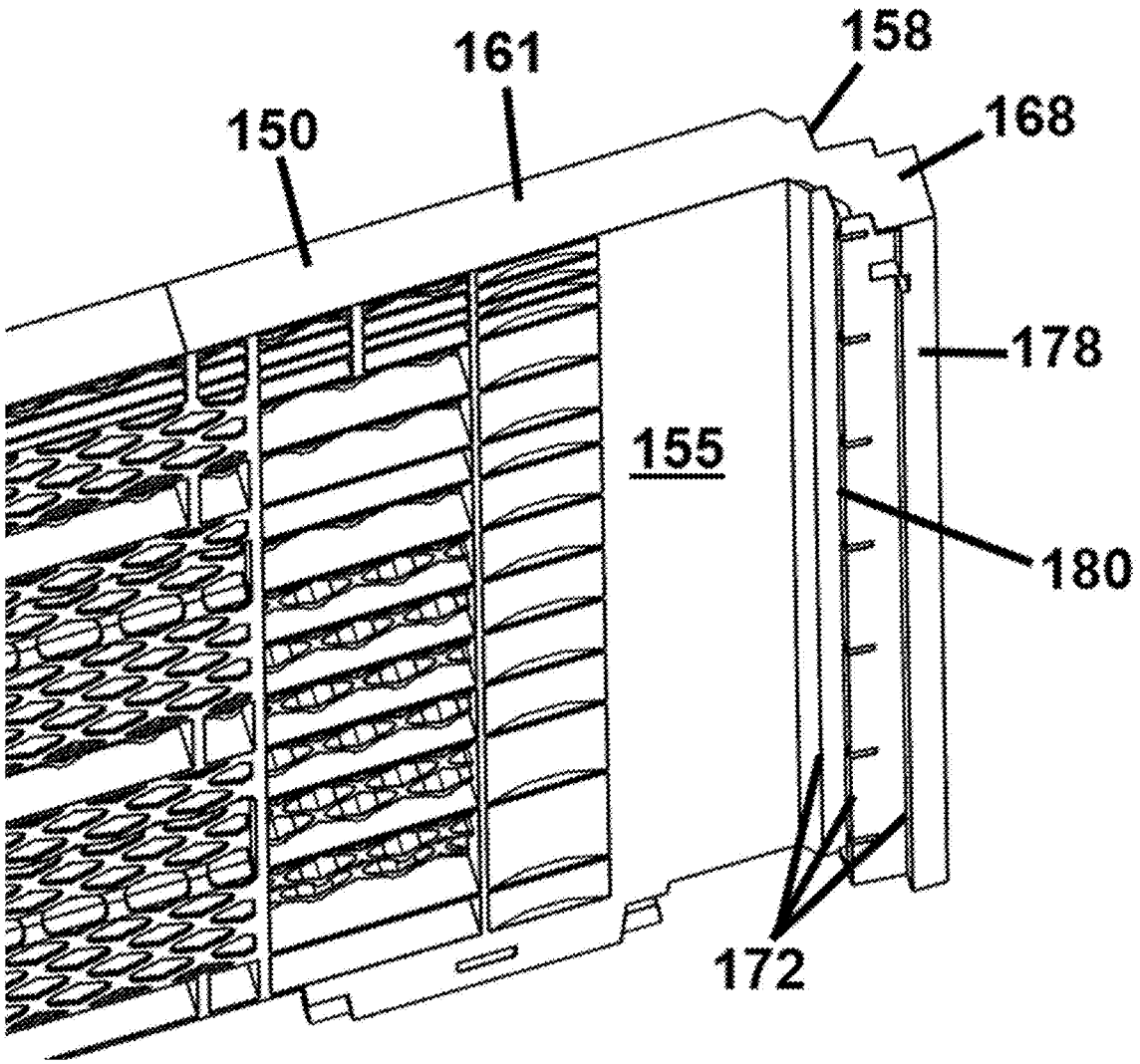
Figure 18C:
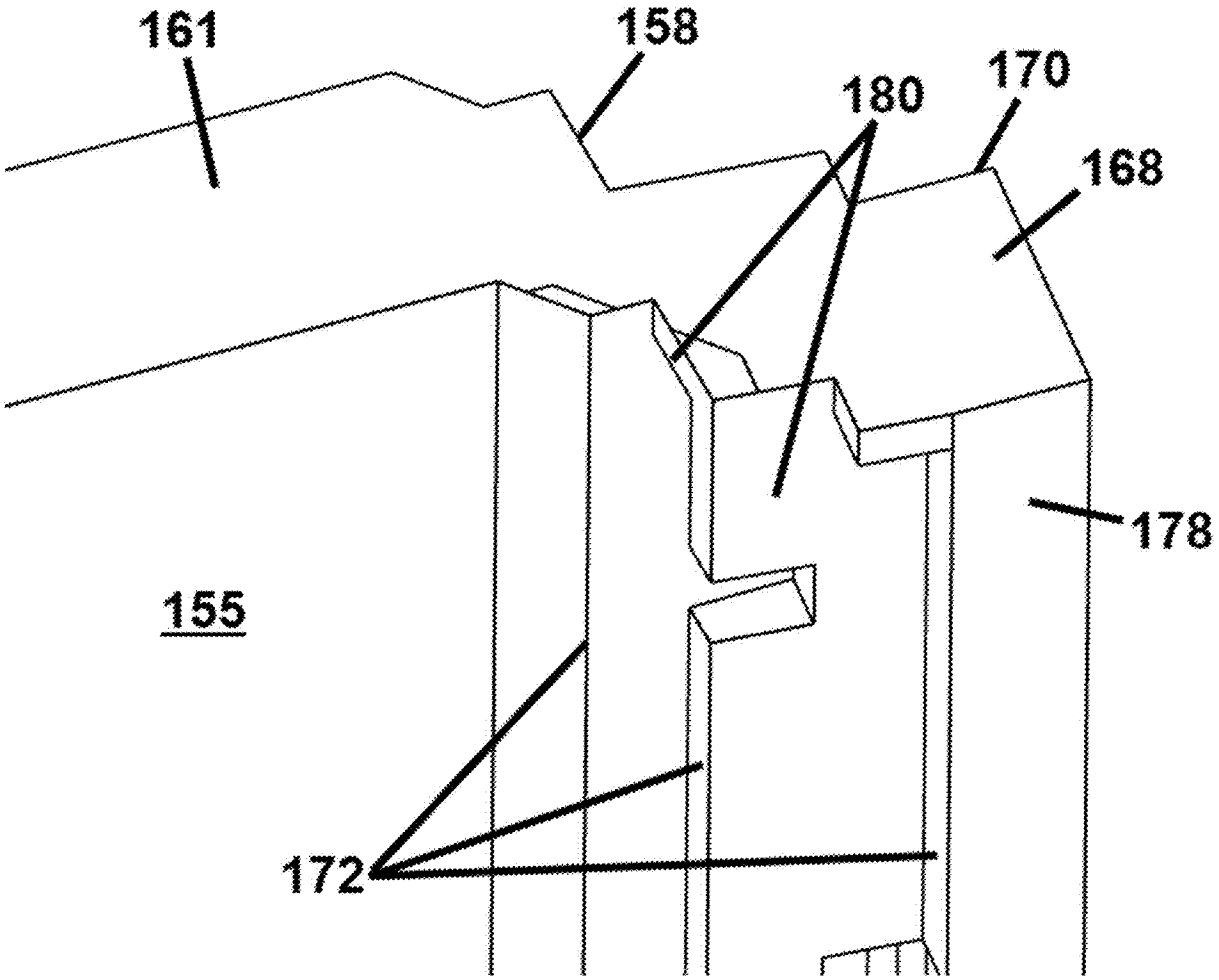
FIG. 18C is a close-up view of a receiving extension for a second sidewall, according to multiple embodiments and alternatives.
Figure 19A:
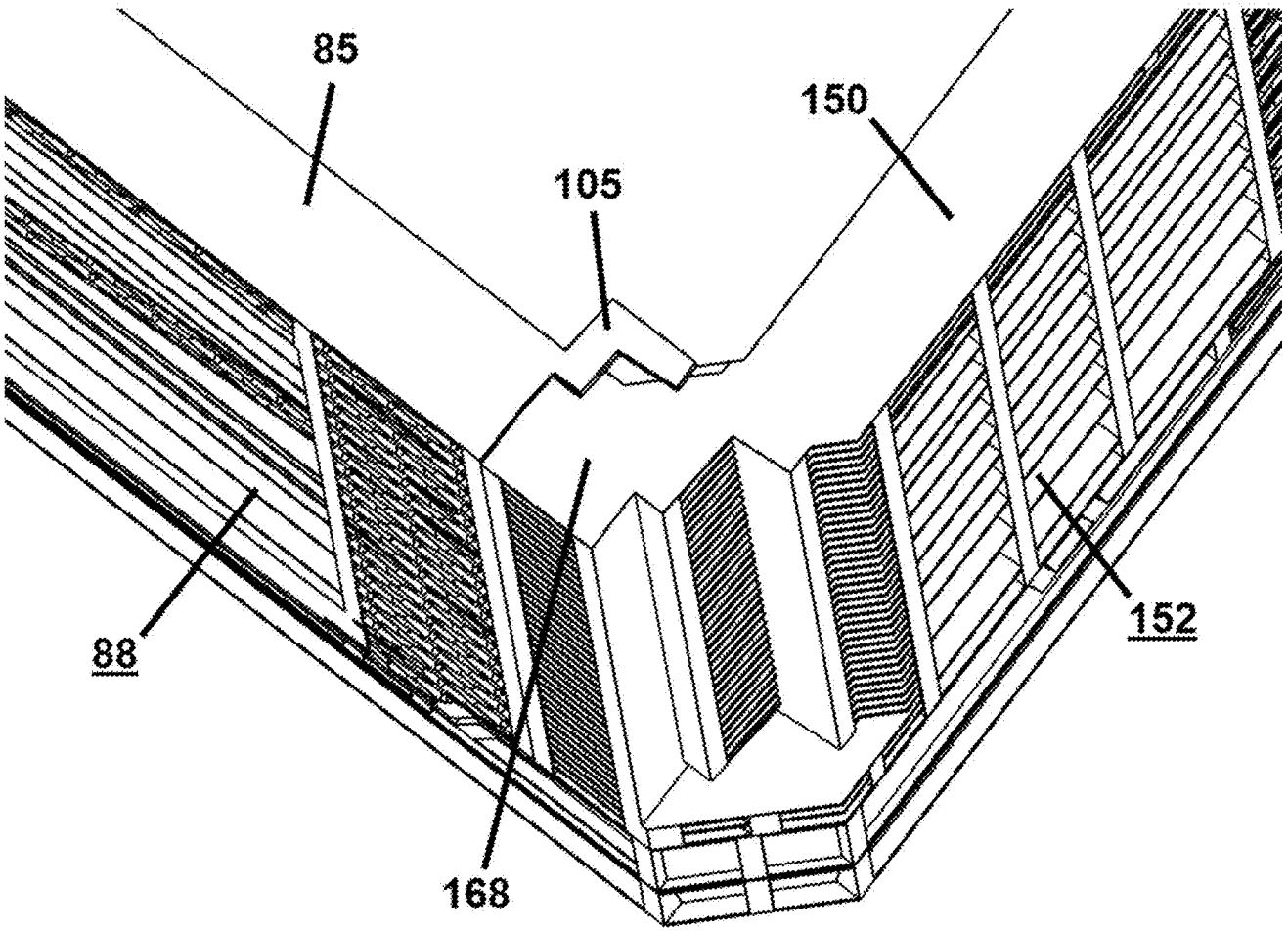
FIGS. 19A-19C are top, perspective views of the connection between a first and second sidewall of a collapsible shipping container, according to multiple embodiments and alternatives.
Figure 19B:
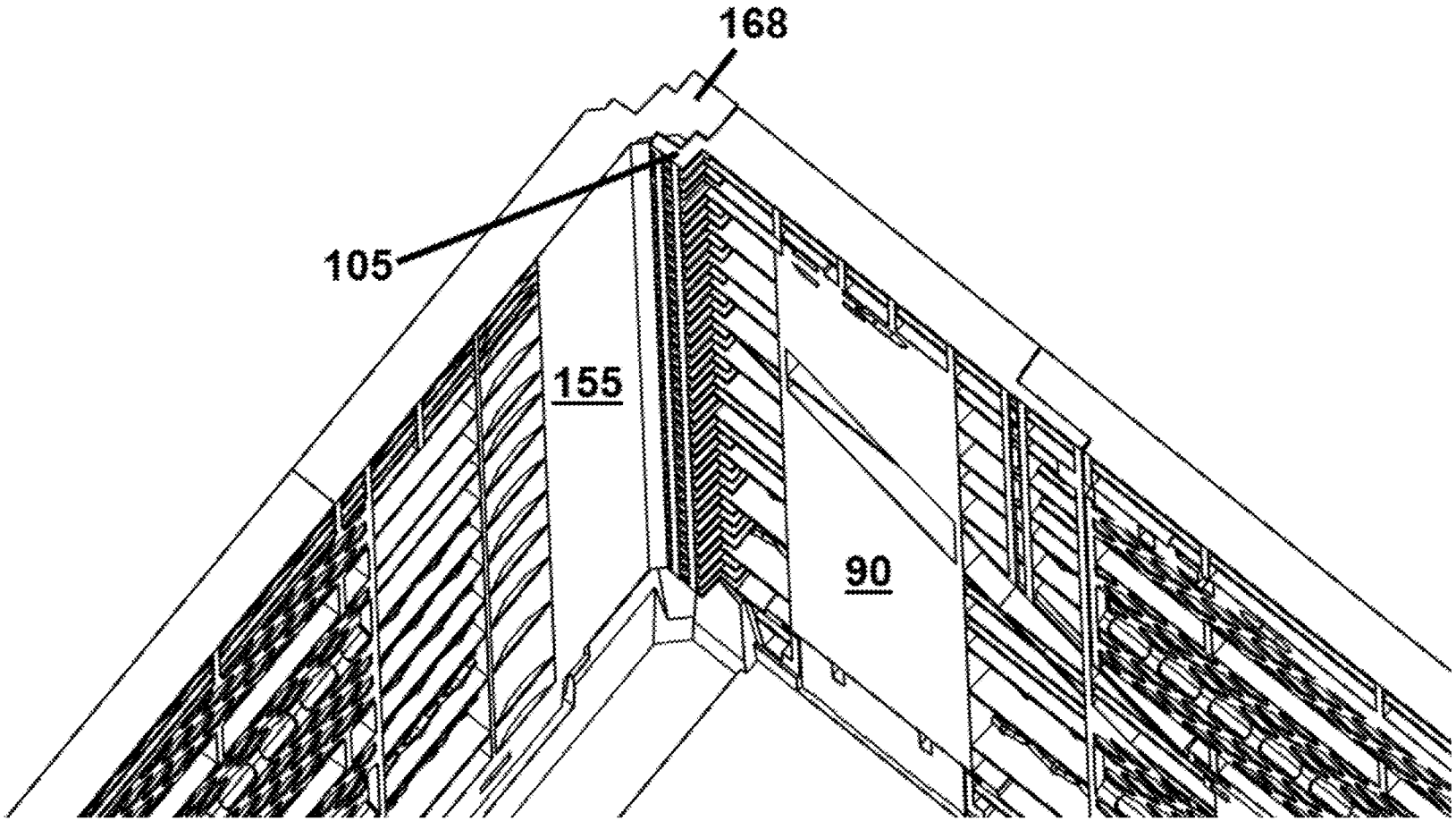
Figure 19C:
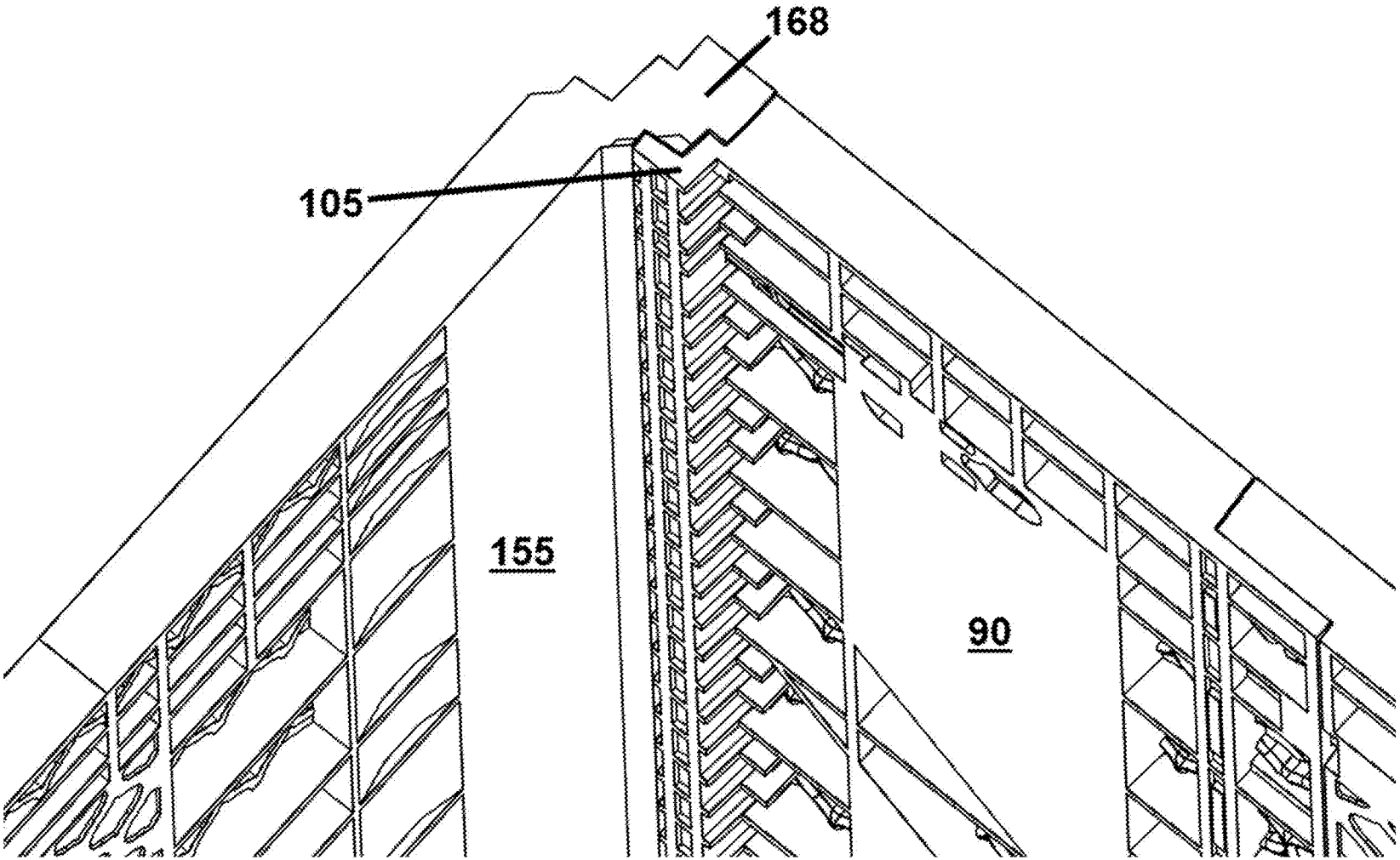

As illustrated in FIGS. 18A to 18C, a receiving extension 168 extends at an inward angle from each of the sides of the second pair of sidewalls 150, is adapted to mate with and receive the wrap-around extension 105 of the first pair of sidewalls 85 and is flush with the top edge 161. The receiving extension 168 extends from each of the intersections between the inner surface 155 and side edge 158 of the second pair of sidewalls 150. The receiving extension 168 comprises a series of stair steps 170 which are positioned along the inner and outer sides of the receiving extension 168 and define a series of ninety-degree angles. In further embodiments, the receiving extension 168 comprises a series of internal support columns 172 which extend vertically along the entire height of the inner side of said receiving extension 168, and a series of external support columns 175 which extend vertically along the entire height of the outer side of said receiving extension 168.

Figure 20B:
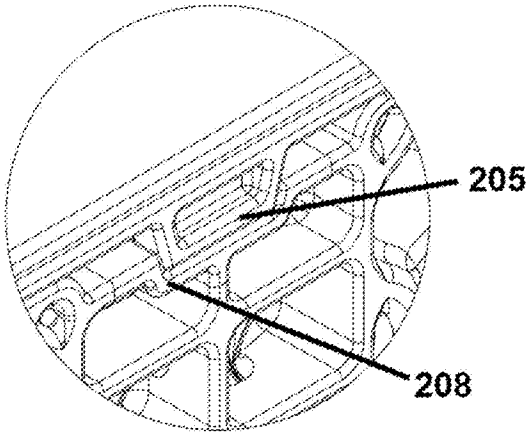
FIGS. 20B-20C are close-up views of the alignment tabs illustrated in FIG. 20A, according to multiple embodiments and alternatives.
Figure 20C:
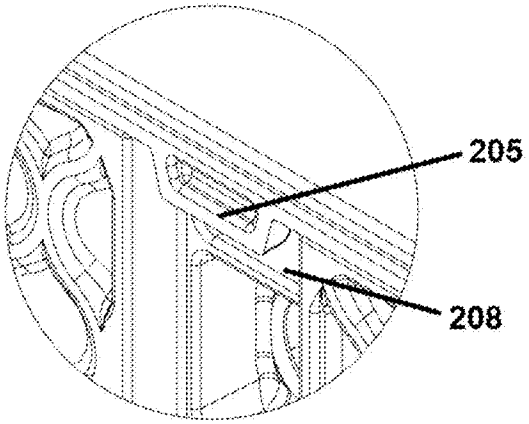
Figure 20A:
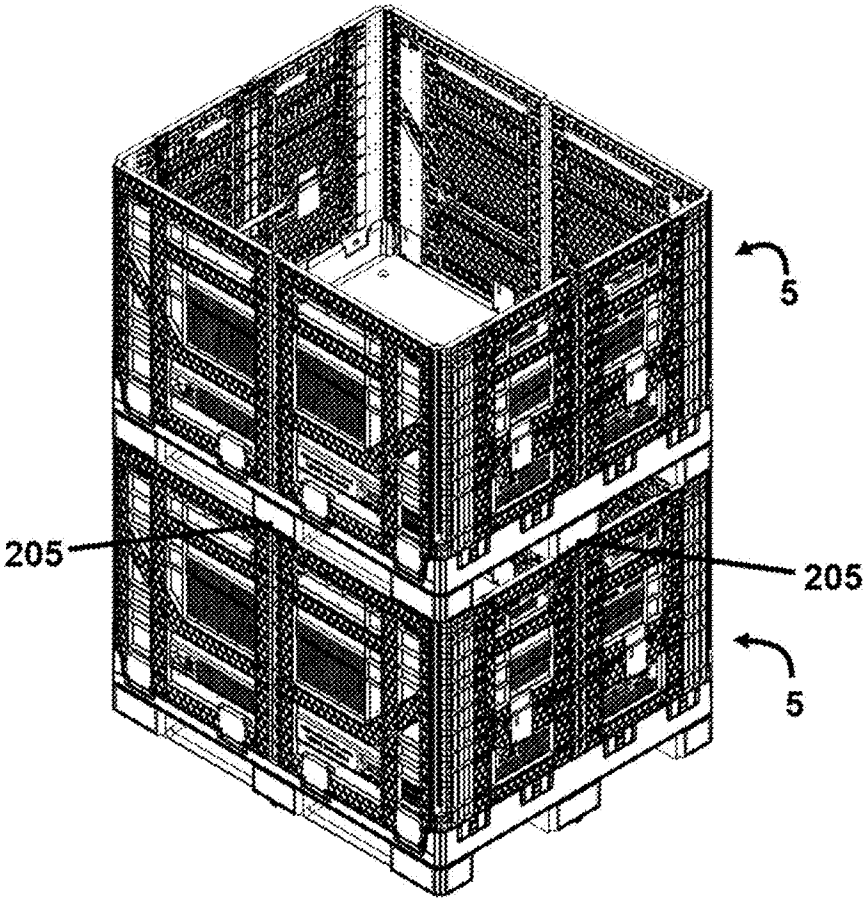
FIG. 20A is a perspective view of an embodiment of a collapsible shipping container having alignment tabs, according to multiple embodiments and alternatives.

FIGS. 20A-20C illustrate a pair of shipping containers 5 stacked on top of one another and having at least one alignment tab 205. According to multiple embodiments and alternatives, the middle component 15 and the end components 12 of the middle unit 27 comprise an alignment tab 205 which extends downward and engages a corresponding slot 208 positioned in the top of the other shipping container. As will be appreciated by one of ordinary skill in the art, the alignment tabs 205 and slots 208 ensure the bins 5 are aligned when stacked on top of one another prevent the sidewalls from bowing outward when under load.

As best illustrated in FIGS. 18C to 19C, the receiving extension 168 defines a side edge receiving surface 178 which is adapted to receive the side edge 95 of the first pair of side walls 85 and an extension receiving surface 180 which is adapted to receive the wrap-around extension 105 of the first pair of sidewalls.

In operation, the user has the option to lower a drop down door 122 from any of the sidewalls 85, 150 (or none of the sidewalls if desired) by slidably engaging the latches 130 and rotating the drop down door 122 up or down along arrows 132', 133'. If a user desires to move the container 5 from the upright position to the collapsed position, the user first slides the latches 115 inwardly until one of the first pair of sidewalls 85 is no longer engaged with the second pair of sidewalls 150. The user then rotates the first sidewall 85 downward along arrow 75' until the sidewall 85 lays flat upon the bottom of the bin 30, and the vertical column 92 is received in the middle recess 32 and the wrap-around extensions 105 are received in the end recesses 32. Next, the user slides the latches 115 inwardly and then rotates the opposing first sidewall 85 downward along arrow 75' until the sidewall lays flat upon the opposing sidewall 85 which is already laying flat. The user then folds in the second pair of sidewalls 150 (in no particular order) until all of the sidewalls 85, 150 lay flat upon the bottom surface 30 of the container 5. The user can stack multiple bins 5 on top of each other by engaging the second set of side rims 50 of a first bin with the receiving grooves 26 on the bottom of a second bin. If a user desires to return the container 5 to the upright position, the user simply rotates the second sidewalls 150 upward until the sidewalls 150 are positioned vertically. Next, the first pair of sidewalls 85 are rotated upward along arrow 78' until the sidewalls 85 are positioned vertically and the latches 115 re-engage with the second pair of sidewalls 150.

It will be understood that the embodiments described herein are not limited in their application to the details of the teachings and descriptions set forth, or as illustrated in the accompanying figures. Rather, it will be understood that the present embodiments and alternatives, as described and claimed herein, are capable of being practiced or carried out in various ways.

Also, it is to be understood that words and phrases used herein are for the purpose of description and should not be regarded as limiting. The use herein of "including," "comprising," "e.g.," "containing," or "having" and variations of those words is meant to encompass the items listed thereafter, and equivalents of those, as well as additional items.

Accordingly, the foregoing descriptions of several embodiments and alternatives are meant to illustrate, rather than to serve as limits on the scope of what has been disclosed herein. The descriptions herein are not intended to be exhaustive, nor are they meant to limit the understanding of the embodiments to the precise forms disclosed. It will be understood by those having ordinary skill in the art that modifications and variations of these embodiments are reasonably possible in light of the above teachings and descriptions.

What is claimed is:

1. A shipping container, comprising:

a first pair of opposing sidewalls;

a second pair of opposing sidewalls;

a base; and a series of curved horizontal protrusions positioned along a length of at least one of the sidewalls in a set of rows;

wherein a vertical column extends from an inner surface of a middle portion of at least one of the first pair of opposing sidewalls;

wherein the base further comprises a base rim which extends vertically from an external edge of said base;

wherein the first and second pairs of sidewalls are pivotably connected to said base rim;

wherein the first and second pairs of sidewalls are adapted to move from an upright position to a collapsed position, and from the collapsed position to the upright position;

wherein the base further comprises a top surface having a middle recess being adapted to receive the vertical column when one of the first pair of opposing sidewalls is in the collapsed positioned.

2. The shipping container of claim 1, wherein the series of curved horizontal protrusions are positioned along a length of the first and second pairs of sidewalls in a set of parallel rows.

3. The shipping container of claim 2, further comprising a series of curved vertical protrusions positioned along a height of the first and second pairs of sidewalls in a set of parallel columns.

4. The shipping container of claim 3, wherein the series of curved horizontal protrusions and the series of curved vertical protrusions each define a convex geometry on an outer surface of the first and second pairs of sidewalls and a corresponding concave geometry on an inner surface of the first and second pairs of sidewalls.

5. The shipping container of claim 1, wherein the first and second pairs of sidewalls each further comprise an inner surface and opposing side edges;

wherein each of the first pair of opposing sidewalls further comprise a wrap-around extension extending from each intersection between the opposing side edges and the inner surface of said first sidewalls;

wherein each of the second pair of opposing sidewalls further comprise a receiving extension extending from each intersection between the opposing side edges and the inner surface of said second sidewalls;

wherein the receiving extension is adapted to receive the wrap-around extension and the side edge of the first pair of sidewalls when the sidewalls are in the upright position.

6. The shipping contain of claim 5, wherein the top surface of the base further defines a pair of opposing end recesses being adapted to receive the wrap-around extensions of the first pair of sidewalls when one of the first pair of opposing sidewalls is in the collapsed positioned.

7. A collapsible shipping container, comprising:

a first pair of opposing sidewalls and a second pair of opposing sidewalls each having an inner surface and opposing side edges; and a base having a base rim which extends vertically from an external edge of said base;

wherein the first and second pairs of sidewalls are pivotably connected to said base rim;

wherein the first and second pairs of sidewalls are adapted to move from an upright position to a collapsed position, and from the collapsed position to the upright position;

wherein each of the first pair of opposing sidewalls further comprise a wrap-around extension extending from each intersection between the opposing side edges and the inner surface of said first sidewalls;

wherein each of the second pair of opposing sidewalls further comprise a receiving extension extending from each intersection between the opposing side edges and the inner surface of said second sidewalls;

wherein the receiving extension is adapted to receive the wrap-around extension and the side edge of the first pair of sidewalls when the sidewalls are in the upright position;

wherein each of the wrap-around extensions comprise a first component integrally connected to a second component, wherein the first component extends towards the inner surface of each first sidewall and the second component extends outwards away from said opposing sides edge of each first sidewall;

wherein the first and second components define about a two-hundred and seventy degree angle which extends along an entire height of the inner surface of said first sidewalls.

8. The shipping container of claim 7, further comprising a pair of external support columns extending vertically along an external side of each wrap-around extension and a pair of internal support columns extending vertically along an internal side of each wrap-around extension.

9. The shipping container of claim 7, wherein each of the receiving extensions extend at an inward angle towards the inner surface of each second sidewall;

wherein each of the receiving extensions further comprise a series of stair steps positioned along an inner and an outer side of each receiving extension.

10. The shipping container of claim 9, further comprising a series of internal support columns extending vertically along an internal side of each receiving extension and a series of external support columns extending vertically along an external side of each receiving extension.

11. The shipping container of claim 7, further comprising a series of curved horizontal protrusions positioned along a length of the first and second pairs of sidewalls in a set of parallel rows and a series of curved vertical protrusions positioned along a height of the first and second pairs of sidewalls in a set of parallel columns.

12. The shipping container of claim 11, wherein the series of curved horizontal protrusions and the series of curved vertical protrusions each define a convex geometry on an outer surface of the first and second pairs of sidewalls and a corresponding concave geometry on an inner surface of the first and second pairs of sidewalls.

13. A collapsible shipping container, comprising:

a first pair of opposing sidewalls and a second pair of opposing sidewalls each having an inner surface, opposing side edges, and a top edge;

a base having a base rim which extends vertically from an external edge of said base;

a series of curved horizontal protrusions positioned along a length of the first and second pairs of sidewalls in a set of parallel rows; and a series of curved vertical protrusions positioned along a height of the first and second pairs of sidewalls in a set of parallel columns;

wherein the first and second pairs of sidewalls are pivotably connected to said base rim, wherein the first and second pairs of sidewalls are adapted to move from an upright position to a collapsed position, and from the collapsed position to the upright position;

wherein each of the first pair of opposing sidewalls further comprise a wrap-around extension extending from each intersection between the opposing side edges and the inner surface of said first sidewalls, said wrap-around extension being flush with the top edge of each first sidewall;

wherein each of the second pair of opposing sidewalls further comprise a receiving extension extending from each intersection between the opposing side edges and the inner surface of said second sidewalls, said receiving extension being flush with the top edge of each second sidewall;

wherein the receiving extension is adapted to receive the wrap-around extension and the side edge of the first pair of sidewalls when the sidewalls are in the upright position.

14. The shipping container of claim 13, wherein the series of curved horizontal protrusions and the series of curved vertical protrusions each define a convex geometry on an outer surface of the first and second pairs of sidewalls and a corresponding concave geometry on an inner surface of the first and second pairs of sidewalls.

15. The shipping container of claim 13, wherein a vertical column extends from an entire height of an inner surface of a middle portion of each first pair of opposing sidewalls;

wherein the base further comprises a top surface having a middle recess being adapted to receive the vertical column and a pair of opposing end recesses being adapted to receive the wrap-around extensions when one of the first pair of opposing sidewalls is in the collapsed positioned.

16. The shipping container of claim 13, wherein each of the wrap-around extensions comprise a first component integrally connected to a second component, wherein the first component extends towards the inner surface of said first sidewalls and the second component extends outwards away from said opposing sides edges of each said first sidewall, wherein the first and second components define about a two-hundred and seventy degree angle which extends along a height of each inner surface of said first sidewalls;

wherein each of the receiving extensions extend at an inward angle towards the inner surface of said second sidewalls, wherein each of the receiving extensions further comprise a series of stair steps defining a series of generally ninety degree angles and positioned along an inner and an outer side of each receiving extension.

17. A collapsible shipping container, comprising:

a first pair of opposing sidewalls and a second pair of opposing sidewalls each having an inner surface and opposing side edges; and a base having a base rim which extends vertically from an external edge of said base;

wherein the first and second pairs of sidewalls are pivotably connected to said base rim;

wherein the first and second pairs of sidewalls are adapted to move from an upright position to a collapsed position, and from the collapsed position to the upright position;

wherein each of the first pair of opposing sidewalls further comprise a wrap-around extension extending from each intersection between the opposing side edges and the inner surface of said first sidewalls;

wherein each of the second pair of opposing sidewalls further comprise a receiving extension extending from each intersection between the opposing side edges and the inner surface of said second sidewalls;

wherein the receiving extension is adapted to receive the wrap-around extension and the side edge of the first pair of sidewalls when the sidewalls are in the upright position;

wherein each of the wrap-around extensions comprise a first component integrally connected to a second component, wherein the first component extends towards the inner surface of each first sidewall and the second component extends outwards away from said opposing sides edge of each first sidewall;

wherein each of the receiving extensions extend at an inward angle towards the inner surface of each second sidewall;

wherein each of the receiving extensions further comprise a series of stair steps positioned along an inner and an outer side of each receiving extension.

18. The shipping container of claim 17, further comprising a series of internal support columns extending vertically along an internal side of each receiving extension and a series of external support columns extending vertically along an external side of each receiving extension.

19. A collapsible shipping container, comprising:

a first pair of opposing sidewalls and a second pair of opposing sidewalls each having an inner surface and opposing side edges; and a base having a base rim which extends vertically from an external edge of said base;

wherein the first and second pairs of sidewalls are pivotably connected to said base rim;

wherein the first and second pairs of sidewalls are adapted to move from an upright position to a collapsed position, and from the collapsed position to the upright position;

wherein each of the first pair of opposing sidewalls further comprise a wrap-around extension extending from each intersection between the opposing side edges and the inner surface of said first sidewalls;

wherein each of the second pair of opposing sidewalls further comprise a receiving extension extending from each intersection between the opposing side edges and the inner surface of said second sidewalls;

wherein the receiving extension is adapted to receive the wrap-around extension and the side edge of the first pair of sidewalls when the sidewalls are in the upright position;

further comprising a series of curved horizontal protrusions positioned along a length of the first and second pairs of sidewalls in a set of parallel rows and a series of curved vertical protrusions positioned along a height of the first and second pairs of sidewalls in a set of parallel columns.

20. The shipping container of claim 19, wherein the series of curved horizontal protrusions and the series of curved vertical protrusions each define a convex geometry on an outer surface of the first and second pairs of sidewalls and a corresponding concave geometry on an inner surface of the first and second pairs of sidewalls.

* * * * *